US009512560B2

(12) United States Patent
Piechuta et al.

(10) Patent No.: US 9,512,560 B2
(45) Date of Patent: Dec. 6, 2016

(54) SHORT OXYGEN DELIGNIFICATION METHOD

(71) Applicant: Quantum Technologies, Inc., Akron, OH (US)

(72) Inventors: Peter A. Piechuta, Uniontown, OH (US); Robert E. Yant, Medina, OH (US)

(73) Assignee: QUANTUM TECHNOLOGIES, INC., Akron, OH (US)

( * ) Notice: Subject to any disclaimer, the term of this patent is extended or adjusted under 35 U.S.C. 154(b) by 0 days.

(21) Appl. No.: 14/530,032

(22) Filed: Oct. 31, 2014

(65) Prior Publication Data

US 2016/0122945 A1 May 5, 2016

(51) Int. Cl.

| | |
|---|---|
| ***D21C 7/02*** | (2006.01) |
| ***D21C 1/02*** | (2006.01) |
| ***B01F 7/02*** | (2006.01) |

(Continued)

(52) U.S. Cl.

CPC ..... *D21C 7/02* (2013.01); *B01F 7/00133* (2013.01); *B01F 7/00141* (2013.01); *B01F 7/00633* (2013.01); *B01F 7/048* (2013.01); *D21C 1/02* (2013.01); *D21C 1/08* (2013.01); *D21C 3/02* (2013.01)

(58) Field of Classification Search

CPC ..... D21C 9/10; D21C 7/00; D21C 11/0057; D21C 1/10; D21C 1/08; D21C 7/02; D21C 1/02; D21C 3/02; B01F 15/0203; B01F 7/00433; B01F 7/048; B01F 7/086; B01F 15/0233; B01F 15/0248; B01F 2215/0078; B01F 7/00325; B01J 19/006; D21B 1/16; F04D 7/045

See application file for complete search history.

(56) References Cited

U.S. PATENT DOCUMENTS 3,754,417 A * 8/1973 Jamieson ..... 68/15
4,133,714 A * 1/1979 Vorobiev et al. ..... 162/237

(Continued)

FOREIGN PATENT DOCUMENTS

CN 2139470 8/1993
EP 338147 A1 * 10/1989 ..... B01J 10/00

(Continued)

OTHER PUBLICATIONS

EPO Machine Translation of CN—2139470, published on Apr. 1993.*

(Continued)

*Primary Examiner* — Jose Fortuna
(74) *Attorney, Agent, or Firm* — Abel Law Group, LLP

(57) ABSTRACT

A short oxygen delignification method employs a mixing assembly including a mixing chamber having an interior wall which is generally symmetrical about a central longitudinal axis. At least one inlet is used to introduce paper pulp, a basic compound, optional steam and an oxygen-containing gas into the mixing chamber. At least one axial baffle is connected to and extends along the interior wall. At least one transverse baffle is connected to and extends from the interior wall transverse to the axis. A rotatable agitator includes at least one agitator baffle extending transverse to the axis at a location in alignment with a respective transverse baffle. This forms at least one gap between the at least one agitator baffle and the at least one respective transverse baffle. The paper pulp fluid is forced to travel through the at least one gap. A short delignification reaction occurs inside the mixing chamber. Delignified paper pulp fluid leaves the mixing chamber through at least one outlet of the mixing chamber.

24 Claims, 15 Drawing Sheets

(51) Int. Cl.

| | |
|---|---|
| ***D21C 1/08*** | (2006.01) |
| ***D21C 3/02*** | (2006.01) |
| ***B01F 7/00*** | (2006.01) |
| ***B01F 7/04*** | (2006.01) |

(56) References Cited

U.S. PATENT DOCUMENTS

| | | | | |
|---|---|---|---|---|
| 4,612,088 | A * | 9/1986 | Nardi | 162/235 |
| 4,740,212 | A | 4/1988 | Yant et al. | |
| 4,834,837 | A | 5/1989 | Loquenz et al. | |
| 4,904,461 | A | 2/1990 | Yant et al. | |
| 4,941,752 | A | 7/1990 | Yant et al. | |
| 5,304,355 | A * | 4/1994 | Yant et al. | 422/225 |
| 5,382,322 | A | 1/1995 | Magnotta et al. | |
| 5,500,084 | A * | 3/1996 | Hoffman | 162/17 |
| 5,500,085 | A | 3/1996 | Magnotta et al. | |
| 5,520,783 | A * | 5/1996 | White et al. | 162/243 |
| 5,607,233 | A * | 3/1997 | Yant et al. | 366/102 |
| 6,036,355 | A * | 3/2000 | Yant et al. | 366/171.1 |
| 2002/0145938 | A1 | 10/2002 | Sasaki | |
| 2003/0053370 | A1 | 3/2003 | Murakami | |
| 2005/0152217 | A1 | 7/2005 | O'Hara | |
| 2008/0025143 | A1 | 1/2008 | Ohashi et al. | |
| 2008/0310253 | A1 | 12/2008 | Hayashi | |
| 2012/0067536 | A1 | 3/2012 | Hautala | |
| 2012/0322972 | A1 | 12/2012 | Koizumi | |
| 2016/0122945 | A1* | 5/2016 | Piechuta | D21C 7/02 162/58 |

FOREIGN PATENT DOCUMENTS

| | | | | |
|---|---|---|---|---|
| WO | WO8703313 | | 6/1987 | |
| WO | WO9904088 | A1 | 1/1999 | |
| WO | WO 9904088 | A1 * | 1/1999 | D21C 11/00 |
| WO | WO 9916539 | A1 * | 4/1999 | B01F 5/04 |

OTHER PUBLICATIONS

U.S. Appl. No. 08/893,601, filed Jul. 14, 1997.

McDonough, T.J. "Oxygen Delignification." The Institute of Paper Chemistry, Appleton, Wisconsin. Jan. 1989.

Wikipedia Article. "Bleaching of Wood Pulp." http://en.wikipedia.org/wiki/Bleaching_of _wood_pulp—accessed Sep. 19, 2014.

The Linde Group. "Gas Applications for the Pulp and Paper Industry." 2012.

Wikipedia Article. "Kraft process." http://en.wikipedia.org/wiki/Kraft_process—accessed Sep. 19, 2014.

Praxair. "Praxair Gases and Technology for Pulp and Paper Making: Oxygen Delignification." Danbury, CT. 1998.

Princeton University. "Pulp Bleaching Technology." https://www.princeton.edu/~ota/disk1/1989/8931/893106.PDF—accessed Sep. 4, 2014.

Van Heningen, et al. "A chemical reactor analysis of industrial oxygen delignification." Pulp and Paper Canada 104 (12): T331-336. Dec. 2003.

Van Heningen, et al. "Southern pine oxygen delignified pulps produced in a Berty throughflow reactor: How to obtain the highest degree of delignification while maintaining pulp yield and quality." Tappi Journal, vol. 11 No. 3. Mar. 2012.

THC. "Precision helical rotors." http://www.gearandrack.com/worm_worm_gears/helical_rotors.html—accessed Oct. 31, 2014.

Lysholm Article. "Piece of Rotary Screw History." Air Compressor Technology, Inc. http://www.airends.com/LysholmArticle.htm—accessed Sep. 4, 2014.

Description of Mixing Assembly Device delivered to Woodland Pulp in Maine 2013.

International Search Report and Written Opinion dated Dec. 28, 2015 for PCT/US2015/056382.

International Search Report and Written Opinion dated Feb. 17, 2016 for PCT/US2015/056378.

* cited by examiner

SHORT OXYGEN DELIGNIFICATION METHOD

FIELD OF THE INVENTION

The present disclosure relates to a short process of oxygen delignification that occurs after mixing a basic compound, paper pulp and oxygen-containing gas in a continuous dynamic mixing assembly having a unique baffle and agitator design.

TECHNICAL BACKGROUND

In some paper pulping processes, a solution referred to as "oxidized white liquor" is used. Oxidized white liquor is typically made by oxidizing reducing compounds found in white liquor such as sodium sulfide, sodium polysulfide and sodium thiosulfate to form an oxidized white liquor having non-reducing compounds such as sodium sulfate therein.

A stirred tank of white liquor and either air or oxygen or a combination thereof and an external heat source is a common method of commercially producing white liquor as disclosed in U.S. Pat. Nos. 5,500,085 and 5,382,322.

Some paper mills, for example, those employing the kraft process, employ one or more oxygen delignification systems for removing lignin from wood chips and subsequently processed paper pulp. Lignin is a complex polymer in wood that binds to cellulose and forms a significant weight of the wood. The presence of lignin is detrimental to paper making where bright white paper is desired. Newspapers that turn yellow when left in the sun change color due to the presence of lignin in the paper. In the kraft process, some lignin may be removed in an initial digestion stage of wood chips carried out at high temperatures with the addition of liquids such as white liquor. The paper pulp which is obtained after further processing may be subjected to a tower oxygen delignification system upstream of a bleaching process. Various chemicals or substances may be used in the bleaching process.

One process of oxygen delignification in modern paper mills employs a basic liquid compound (e.g., alkali), pumped paper pulp fluid and oxygen gas under pressure. The combined material moves up a tall, vertically extending hollow tower and an oxygen delignification reaction occurs. The paper pulp fluid may be washed or not but travels down along conduit toward the ground. From here it may be subsequently treated (e.g., in a bleaching operation) or passed to an optional second hollow tower where secondary delignification occurs. The paper pulp fluid that has undergone secondary delignification may then travel along a conduit toward the ground and be further treated (e.g., in a bleaching operation). Very large amounts of fluid may be contained in the tower or towers, for example, two hundred thousand gallons. The oxygen delignification reaction that occurs inside the tower is slow. The delignification occurring in a single tower may take about 90 minutes, for example. During the oxygen delignification, due to the action of oxygen radicals on the lignin the bonds between the lignin and the cellulose of the paper pulp are broken. A goal of oxygen delignification in this process is to achieve a certain reduction in kappa number, for example, a reduction of at least 50%. This, along with subsequent bleaching, results in paper having suitable brightness. The oxygen delignification process is advantageous because it avoids the need to use certain chemicals for further bleaching and/or reduces the amounts of chemicals needed for bleaching. Reducing bleaching chemicals reduces cost and protects the environment.

The capital cost, operational costs and maintenance costs of the oxygen delignification tower system are very high. Such a tower costs many millions of dollars to construct. Paper mills could benefit from an improved oxygen delignification process, which uses equipment at a fraction of the capital cost, operates much faster, and achieves at least the same results as conventional tower oxygen delignification systems. It would be advantageous if such an improved system can be coupled with the conventional tower oxygen delignification system or can replace it entirely.

SUMMARY OF THE DISCLOSURE

The present disclosure is directed to a short oxygen delignification method that employs a continuous dynamic mixing assembly which mixes flowable material including an oxygen-containing gas (e.g., including oxygen and/or $CO_2$), a liquid including paper pulp, optional steam and a liquid basic compound. Lignin is bound to the paper pulp. Steam can be used to raise the temperature of the flowable material. A heating source instead of steam can be used, for example, hot oxidized white liquor. The flowable materials may all be mixed together before being directed into the mixing chamber or one or more of the flowable materials may be introduced separately into the mixing chamber. For example, the paper pulp fluid, the optional steam, the basic compound and the oxygen-containing gas may be combined together before entering the mixing chamber. On the other hand, the paper pulp fluid and the optional steam may be combined as a first component, the basic compound may be separately added to this as a second component, which enters the mixing chamber mixed together, and the oxygen-containing gas as a third component may be separately introduced into optional gas inlet ports or insert assemblies into the mixing chamber. Other variations of combinations and components of the flowable materials and manner in which they enter the mixing chamber may also be suitable in this disclosure. The mixing assembly employs axially extending baffles and transverse baffles along with a unique, baffled agitator design that enables very rapid and efficient mixing of the flowable materials carrying out the short oxygen delignification process.

The mixing assembly used in the method of the present disclosure is particularly well suited for conducting delignification chemical reactions by the combination of the oxygen-containing gas (e.g., including oxygen and/or $CO_2$) and the paper pulp fluid and the liquid basic compound for chemical reaction. When the oxygen-containing gas, the paper pulp liquid, the optional steam and the liquid basic compound are mixed in the mixing chamber, delignification advantageously occurs in a relatively short time interval, using relatively little energy. These and other advantages arise from the interplay of the mixing chamber baffling system and the unique agitator design with baffles causing a high degree of mixing.

The dynamic mixing assembly used in the method of the present disclosure enables the efficient dispersion, dissolution and reaction when the flowable materials are combined. In the present disclosure the delignification reactions can occur, for example, at least on the order of 15 times faster than in a conventional tower delignification system, with apparatus that is a fraction of the size and capital cost. These and other advantages are obtained by the combination of, inter alia, the design of the axial and transverse baffles and the agitator baffles.

While not wanting to be bound by theory, this much higher reaction rate is believed to occur as a result of very high temperature conditions in a reaction zone inside the mixing chamber. Cavitation or implosion of gas bubbles in the reaction zone inside the mixing chamber, is believed to release incredibly high heat at point locations inside the mixing chamber, which is believed to cause the dramatic increase in reaction rate.

The design of the agitator baffles, and axial and transverse baffles of the mixing chamber offer numerous advantages and serve a plurality of purposes. The mixing chamber baffle systems disrupt axial and circumferential fluid flow and enable efficient mixing. Referring to axial flow in this disclosure means flow that occurs substantially along the longitudinal axis of the mixing chamber. It should be realized that the fluid flow inside the mixing chamber of this disclosure is complex and reference to inhibiting or disrupting axial fluid flow and circumferential fluid flow are only intended to generally assist in the illustration of the effects of the baffles inside the mixing chamber without unduly limiting the disclosed method. This disclosure and the accompanying drawings should not be taken as a precise explanation of fluid flow and gas flow, and all reaction(s), occurring inside the mixing assembly during the disclosed method. Referring to circumferential fluid flow in this disclosure means non-axial fluid flow fluid flow near the interior wall of the mixing chamber.

The baffles function especially well with the rotatable agitator having arcuate blades, lobes, threads or the like. For example, the blades can be twisted helical along a cylindrical hub of the shaft of the agitator with a constant height. Another variation employs straight, rather than twisted, blades extending diagonally along a flat surface of the agitator shaft or hub, the blades being arcuate. In the case of the twisted or helical blades, a space between the outermost edge portion of a blade or blade tip and innermost edge of an adjacent axial baffle at their closest distance, exists as each of the blades passes an axial baffle. A twisted blade design along the longitudinal axis enables the blade tips to utilize a sweeping action relative to the inward edges of the axial baffles. Since the blades are twisted, only a small portion of the blade tip is closest to an adjacent axial baffle at one time forming the space. As the agitator rotates, the closest distance between the twisted blade tip and the innermost edge of the axial baffle (i.e., the space) progresses in one direction along a length of the axial baffle in a direction of the longitudinal axis. Once the blade tip of that particular blade reaches an end of a particular segment, the next circumferentially offset twisted blade in that segment now has its closest portion of the blade tip at a start of that axial baffle in that segment. When viewed from a cross-sectional end view, the four blades, for example, in each axial segment each twist for a span of, for example, about 90 degrees. In particular, the blades in the downstream segment can be circumferentially offset in a cross-sectional end view such that the starting location of each of the blades in the downstream axial segment is between the end point of blades in the upstream axial segment. For example, the axial baffles of a downstream axial segment circumferentially offset from the axial baffles of the adjacent upstream axial segment in a cross-sectional end view. That is, the axial baffles of the downstream segment are located between the axial baffles of the upstream axial segment from an end view. The sweeping of the twisted and straight arcuate blades past the axial baffles causes a mixing action and further lessens mixing power consumption. Generally, one point of a blade tip at a time is separated from one point on an adjacent axial baffle edge by the predetermined space, which maximizes mixing efficiency. The flow in the mixing chamber can be increased or retarded based upon the speed and rotational direction of the agitator, in view of its twisted or straight arcuate blade orientation.

While not wanting to be bound by theory, the mixing assembly is believed to enable the formation of three fluid zones, an inner, primarily gas zone around and near the agitator, a primarily liquid (including liquid and solid) zone radially outward from the gas zone and near the inner wall of the mixing chamber, and a reaction zone between the liquid and gas zones and extending to the interior wall of the mixing chamber having a combination of solid, liquid and gas.

A general aspect of the disclosure features a method of oxygen delignification comprising the following steps. A mixing chamber is provided having an interior wall which is substantially symmetrical about a central longitudinal axis. At least one inlet for directing flowable material into the mixing chamber is provided. The flowable material includes paper pulp, an oxygen-containing gas, a basic compound and optional steam. Lignin is bound to the paper pulp. The oxygen-containing gas can include, for example, $O_2$ and/or $CO_2$. $CO_2$ can be added for pH control to a desired level. At least one outlet is provided from the mixing chamber. At least one axial baffle is connected to the interior wall and has a length extending along the axis. At least one transverse baffle is provided connected to the interior wall and having a major dimension extending from the interior wall transverse to the axis. A rotatable agitator is provided extending along the axis and includes at least one agitator baffle extending transverse to the axis at a location in alignment with a respective at least one transverse baffle. At least one gap is formed between the at least one agitator baffle and a respective at least one transverse baffle. The flowable material is directed through the at least one fluid inlet into the mixing chamber. The agitator is rotated inside the mixing chamber. Substantially circumferential fluid flow is disrupted in the mixing chamber with the at least one axial baffle. Substantially axial fluid flow is disrupted in the mixing chamber with the at least one transverse baffle and the at least one agitator baffle. The flowable material inside the mixing chamber is forced to travel through the at least one gap. A short delignification reaction occurs in the mixing chamber so as to break bonds between the lignin and the paper pulp and to allow the lignin to dissolve in the basic compound, forming a delignified paper pulp mixture. The delignified paper pulp mixture is removed from the mixing chamber though the at least one outlet. The delignified paper pulp mixture may then be degassed. Reference to transverse to the axis in this disclosure does not require a perpendicular orientation relative to the axis.

More specific features of the general aspect of the disclosure will now be described. A residence time of the flowable material in the mixing chamber can be less than 2 minutes. Another feature is that paper pulp in the delignifled paper pulp mixture passing through the at least one outlet can exhibit at least a 50% reduction in kappa number compared to paper pulp in the flowable material flowing through the at least one inlet. Another feature can include the step of passing the flowable material tangentially through the at least one inlet into the mixing chamber. Another feature can include passing the delignifled paper pulp mixture tangentially through the at least one outlet from the mixing chamber.

Yet another specific feature comprises providing a venturi upstream of the at least one inlet and mixing in the venturi a fluid of the basic compound into an aqueous fluid of the paper pulp to form the flowable material which is then passed through the at least one inlet into the mixing chamber. The oxygen-containing gas and steam may or may not be present with the paper pulp fluid upstream of the venturi. A mixing device may be employed into which the paper pulp fluid, the steam, the oxygen-containing gas, and the fluid of the basic compound are all combined before entering the at least one inlet of the mixing chamber. On the other hand, the oxygen-containing gas may enter the mixing chamber separately from the paper pulp, optional steam and the fluid of the basic compound, through at least one gas inlet into the mixing chamber.

The method can comprise providing at least two of the transverse baffles and at least two of the agitator baffles. The aligned transverse baffles and agitator baffles partition the mixing chamber into at least three axial segments. The blades can be twisted along the axis (e.g., helical). The blades can also extend along flat faces of the agitator diagonally along its length and have arcuate portions. The agitator is rotated in the mixing chamber that includes these baffles.

The at least one axial baffle can extend from an outer periphery of the mixing chamber inwardly toward the agitator. In one version, both sides of the at least one axial baffle are contacted with the fluid. However, these baffles may degrade the strength of the pulp fibers somewhat. In a second design, the at least one axial baffle includes a baffle assembly having a plate and support legs. The support legs fasten the plate to the interior wall of the mixing chamber. The method includes contacting only one side of the plate with the fluid. The baffle assembly of the second design is imperforate. One feature is that the plates may be diametrically opposed from each other in at least one segment of the mixing chamber.

Another specific feature is that the basic compound can be selected from the group consisting of oxidized white liquor, ozone, a peroxide compound, oxidized green liquor, sodium hydroxide, sodium bicarbonate and combinations thereof. Ozone and peroxide may particularly be used in a second mixing assembly in series with a first mixing assembly or downstream of one or more of the mixing assemblies. While the presence of free radicals is advantageous for delignification, it may be beneficial to limit the formation of free radicals due to their effect of degrading the pulp, by employing basic compounds of lower pH (e.g., in order of decreasing pH: NaOH (sodium hydroxide), $Na_2CO_3$ (oxidized green liquor), $NaHCO_3$ (sodium bicarbonate, which can be obtained by adding $CO_2$ to oxidized green liquor) and $H_2O_2$).

Other specific features are that a value of horsepower to volume of the mixing assembly is 1 to 20 or greater, where horsepower is the power at which the motor is rated and volume is a volume of the mixing chamber in gallons. Also, mass transfer of the mixing assembly is, for example, at least 3.52 lb-mol of $O_2/ft^3$, where mass transfer=mass $O_2$/reaction volume throughput from the mixing chamber. Further, the agitator can be rotated at a rotating speed of at least 60 rpm.

A second aspect of the disclosure features providing first and second mixing assemblies in series. The delignified paper pulp mixture from the at least one outlet of the first of the mixing assemblies is passed to the at least one inlet of the second of the mixing assemblies. A second delignification reaction is carried out in the second mixing assembly such that the delignified paper pulp mixture that exits the mixing chamber of the second mixing assembly is further delignified compared to the delignified paper pulp mixture that exits the mixing chamber of the first mixing assembly. Another feature is that optional flowable material selected from the group consisting of a basic compound, oxygen-containing gas, steam and combinations thereof, can be added to the delignified paper pulp mixture that passes through the at least one first inlet of the second mixing assembly. Also, the method can comprise optional degassing of the delignified pulp mixture that leaves the first mixing assembly before the delignified pulp mixture passes through the at least one inlet of the second mixing assembly.

After the pulp mixture exits a final one of the mixing assemblies in any aspect of this disclosure, it may be put into a degasser and inert gas and any unreacted oxygen gas is vented. The total time throughout the entire process of flowable material combination, residence time in the mixing assembly (e.g., not more than 2 minutes) and degassing, is less than 10 minutes, for example. Those skilled in the art will appreciate that various valves can be used in the system of this disclosure.

A third aspect of the disclosure features carrying out delignification in the mixing assembly of the disclosure and then passing this up a tower (e.g., a conventional oxygen delignification hollow tower, e.g., as a pressure vessel, without a stirrer or agitator in the tower) for further delignification. The amount of time the material spends in the tower may be less than the typical, approximately 90 minute duration (e.g., and can be on the order of 60 minutes of less). Washing and degassing may or may not then occur. The material travels along a conduit from the tower toward the ground for further processing. This results in a further delignified paper pulp compared to what is produced from the conventional oxygen delignification tower process in which caustic, pressurized oxygen, and paper pulp fluid are pumped up the tower or towers.

It should be appreciated that any of the above specific features can be combined in any combination in the general aspect of the disclosure, second aspect or third aspect. For example, the mixing assembly can be operated so as to achieve one, two or all of the the recited value of the ratio of horsepower to volume, mass transfer, rotating speed and/or residence time. Moreover, the mixing assembly can include at least two transverse baffles and agitator baffles, forming at least three axial segments. The transverse baffles can be annular shaped with a substantially circular opening and the agitator baffles can have a substantially circular periphery and be disposed inside the circular opening of the respective transverse baffle. This forms annular gaps. In addition, the blades on the agitator can be twisted or helical shaped. Also, the design can be used in which the agitator includes flat faces and straight blades extend diagonally along the faces in a direction of a length of the agitator, wherein the blades have an arcuate portion. Other suitable bladeless agitators may be used and would be apparent to those skilled in the art in view of this disclosure, for example, using a helical screw or lobes. Any of the features in the detailed description can be used in combination with the general aspect, second aspect, third aspect, or specific features thereof.

Further advantages are that the transverse baffles and agitator baffles aligned with them can advantageously partition the mixing chamber into at least two axial segments and in particular, three or more axial segments. When liquid contacts the transverse baffles it is directed inwardly toward the agitator. In addition, when gas traveling along the agitator contacts an agitator baffle, it is directed outwardly, impeding gas from passing through the mixing chamber unreacted. The present mixing assembly is particularly well suited for conducting short oxygen delignification, in view of its thorough and rapid solid/liquid/gas mixing and reaction. The generally radial space between the agitator blade tips and axial baffles, as well as the gap between the agitator baffles and the transverse baffles, can be adjusted in the design of the mixing assembly, which enables the reaction zone size, and thus the residence time of the flowable material, to be selectively adjusted. Unique mixing and chemical reaction occur in the mixing chamber according to this disclosure, among other things, as a result of the relative construction and arrangement of the gaps between the agitator baffles and the transverse baffles. Despite each of these gaps having a relatively small area, all flowable material inside the mixing assembly, including solid, liquid and gas, needs to pass through these gaps. As a result, complex fluid flow occurs inside the mixing chamber. Even though the agitator may rotate rapidly, the solid, liquid and gas do not travel straight through the mixing chamber, but are impeded by the baffle arrangement.

Many additional features, advantages and a fuller understanding of the disclosure will be had from the accompanying drawings and the detailed description that follows.

Figure 1A:
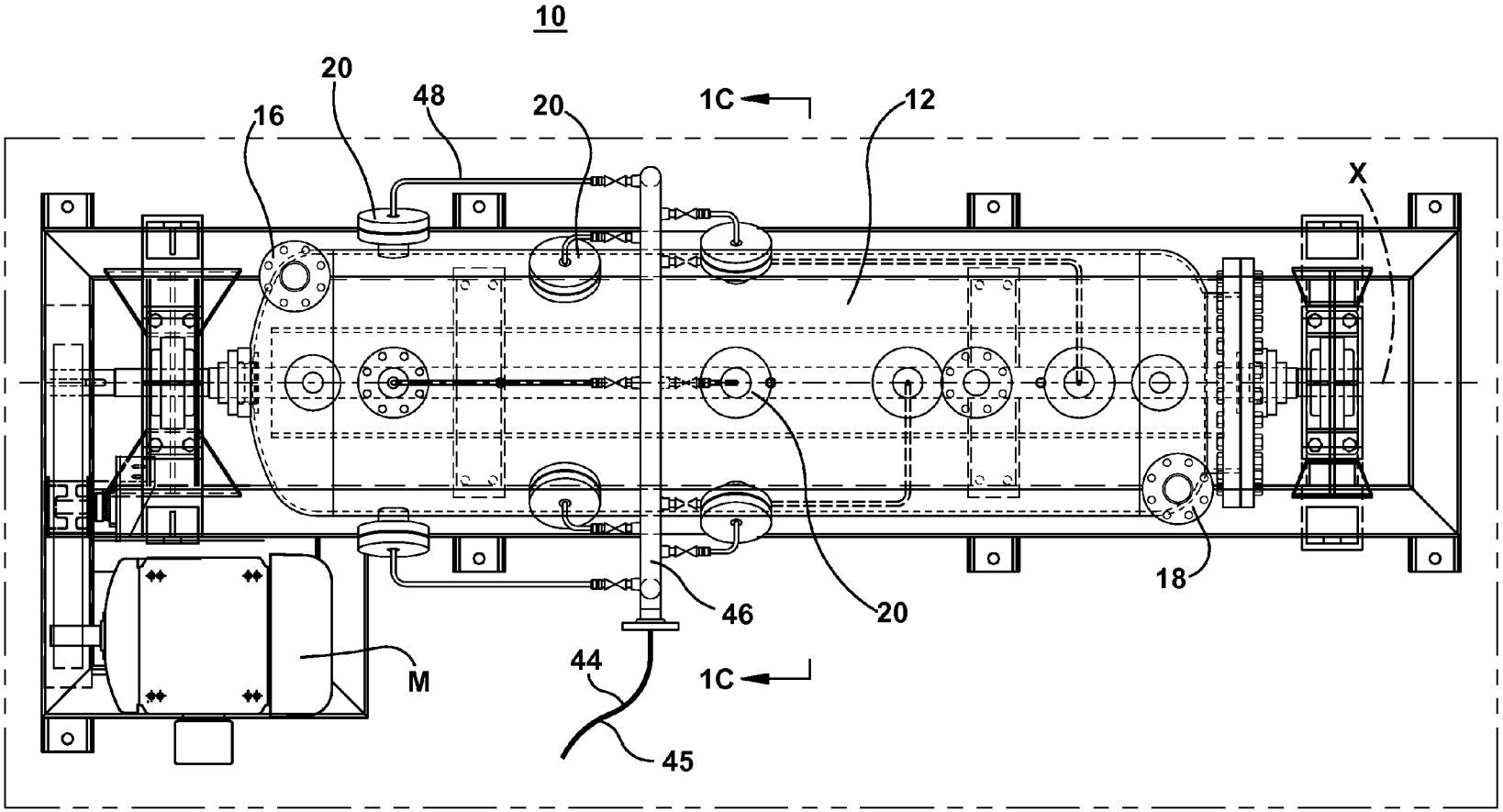
FIG. 1A is a top plan view of the mixing assembly used in the method of this disclosure.
Figure 1B:
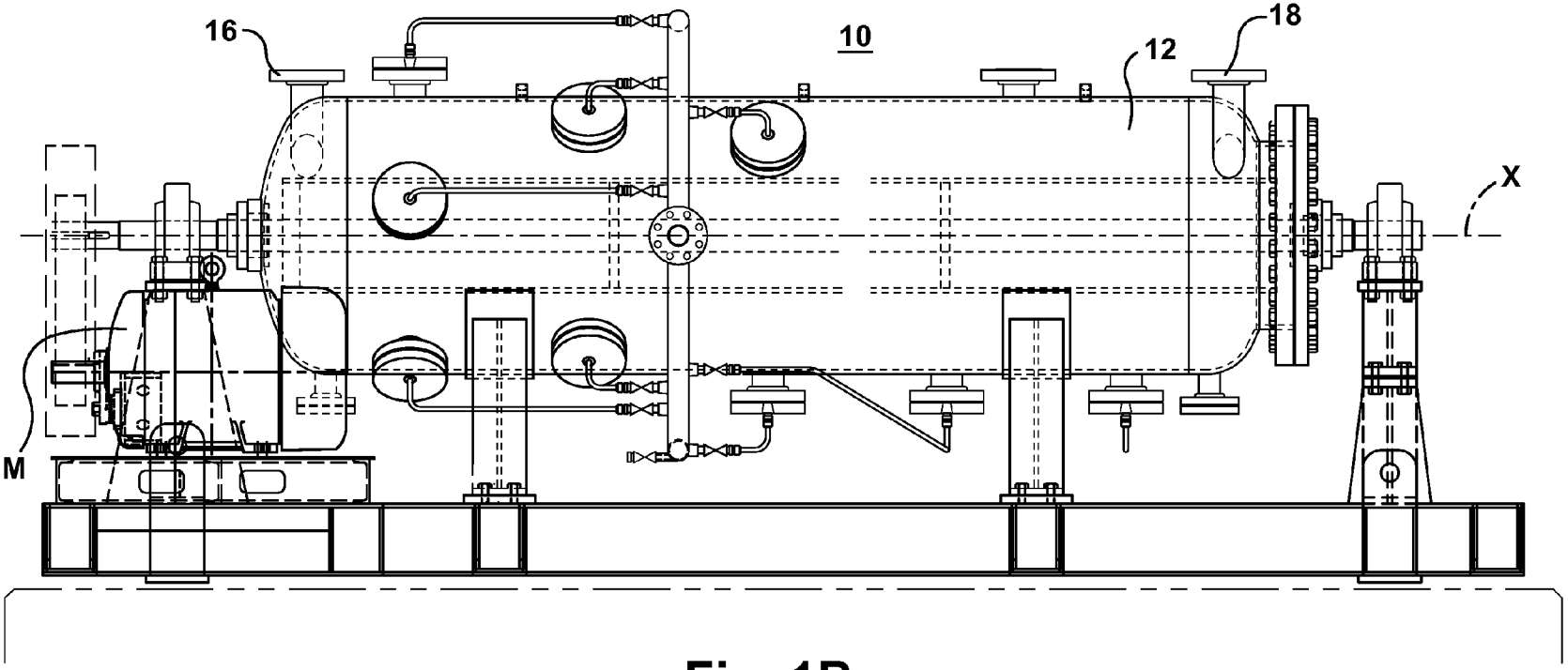
FIG. 1B is a front view thereof.
Figure 1C:
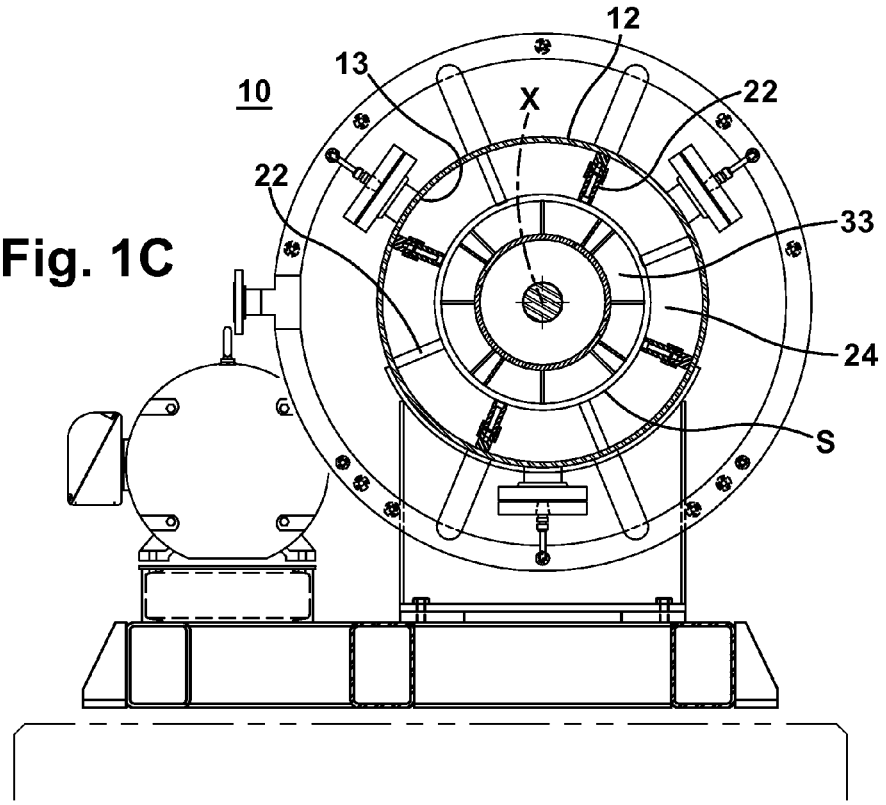
FIG. 1C is a cross-sectional view taken along lines 1C-1C in FIG. 1A.

The drawings included as a part of this specification are intended to be illustrative of preferred embodiments of the invention and should in no way be considered a limitation on the scope of the invention.

DETAILED DESCRIPTION OF THE DISCLOSURE

Referring now to the drawings, a mixing assembly 10 permits mixing of the flowable material, a delignification reaction and lignin dissolving inside the mixing chamber. The flowable material includes paper pulp (a liquid and suspended solids), optional steam (for increasing reaction temperature), a basic compound and an oxygen-containing gas. The basic compound, for example, is selected from the group consisting of oxidized white liquor, sodium hydroxide, sodium bicarbonate, a peroxide compound, ozone, oxidized green liquor and combinations thereof. The mixing assembly comprises a generally cylindrical mixing chamber 12 having an interior wall 13. The mixing chamber is substantially symmetrical about a central longitudinal axis X (FIG. 1). The mixing chamber can be substantially horizontally extending. At least one inlet 16 is connected to the mixing chamber 12 through which the flowable material is introduced into the mixing chamber 12. At least one outlet 18 is connected to the mixing chamber 12 and discharges a delignified paper pulp mixture (including solid, liquid and gas) from the mixing chamber 12. Optional at least one gas inlet 20 (some of which being labeled in FIG. 1A) are disposed at a plurality of locations around the mixing chamber for introducing optional oxygen containing gas into the mixing chamber.

Figure 2A:
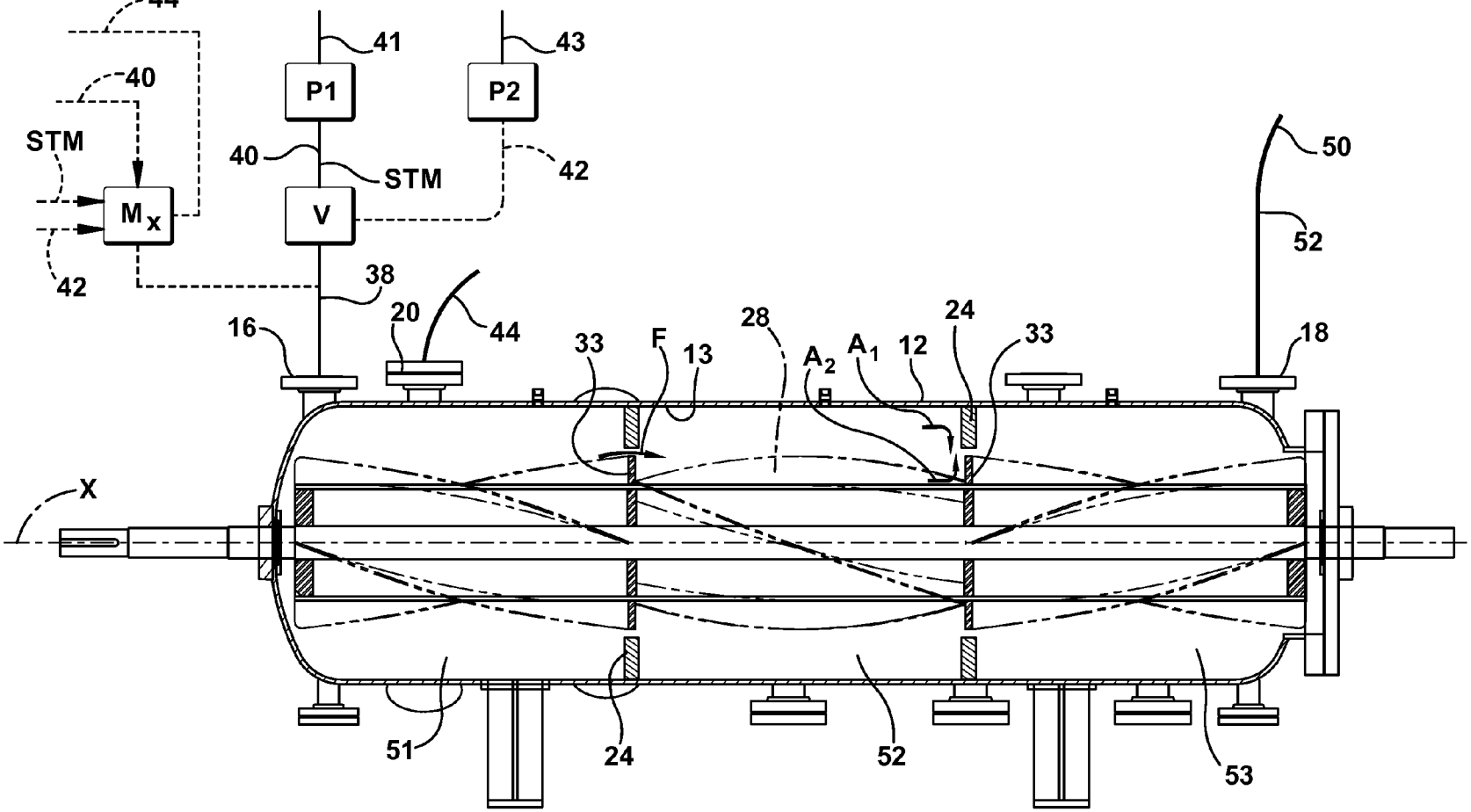
FIG. 2A is a cross-sectional front view of the mixing assembly, without the axial baffles.
Figure 2B:
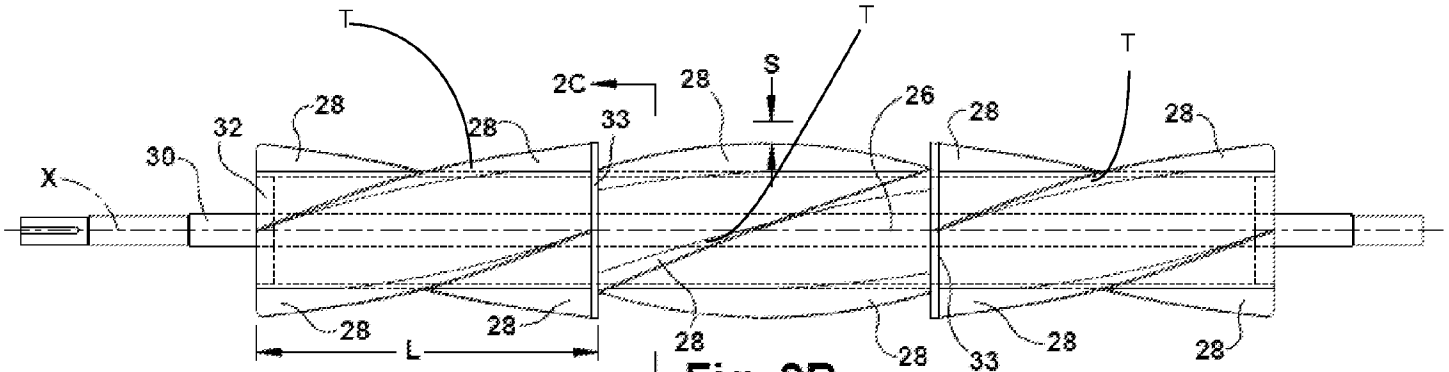
FIG. 2B is a view of the agitator of FIG. 2*a*.
Figure 2C:
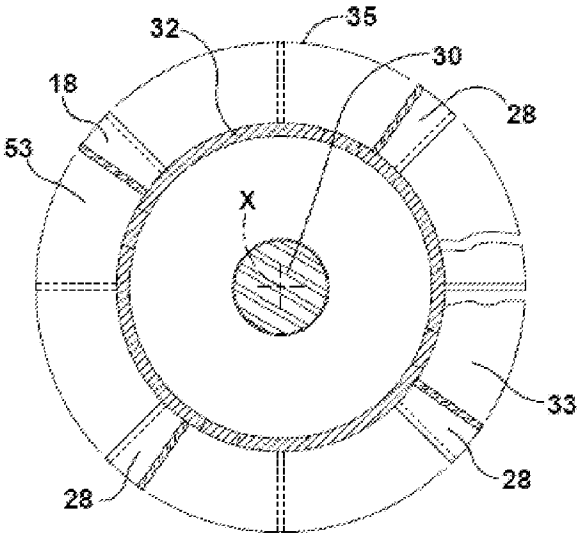
FIG. 2C is a view taken along lines 2-C of FIG. 2A.
Figure 2D:
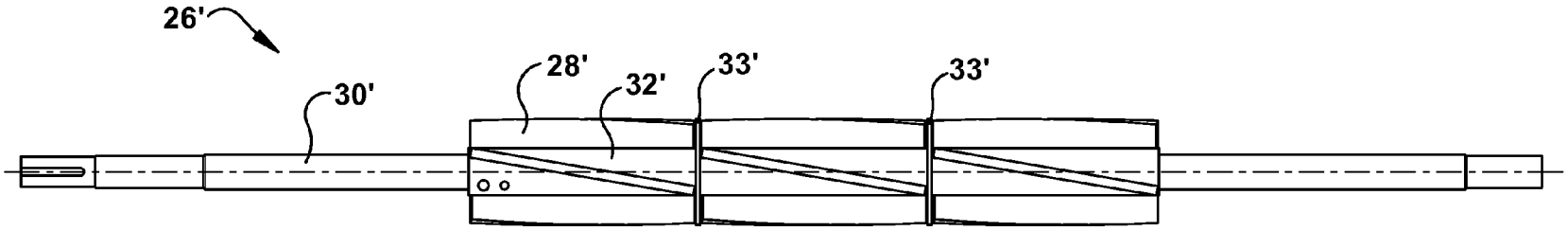
FIG. 2D is a front view of an agitator of a second design according to this disclosure.
Figure 2E:
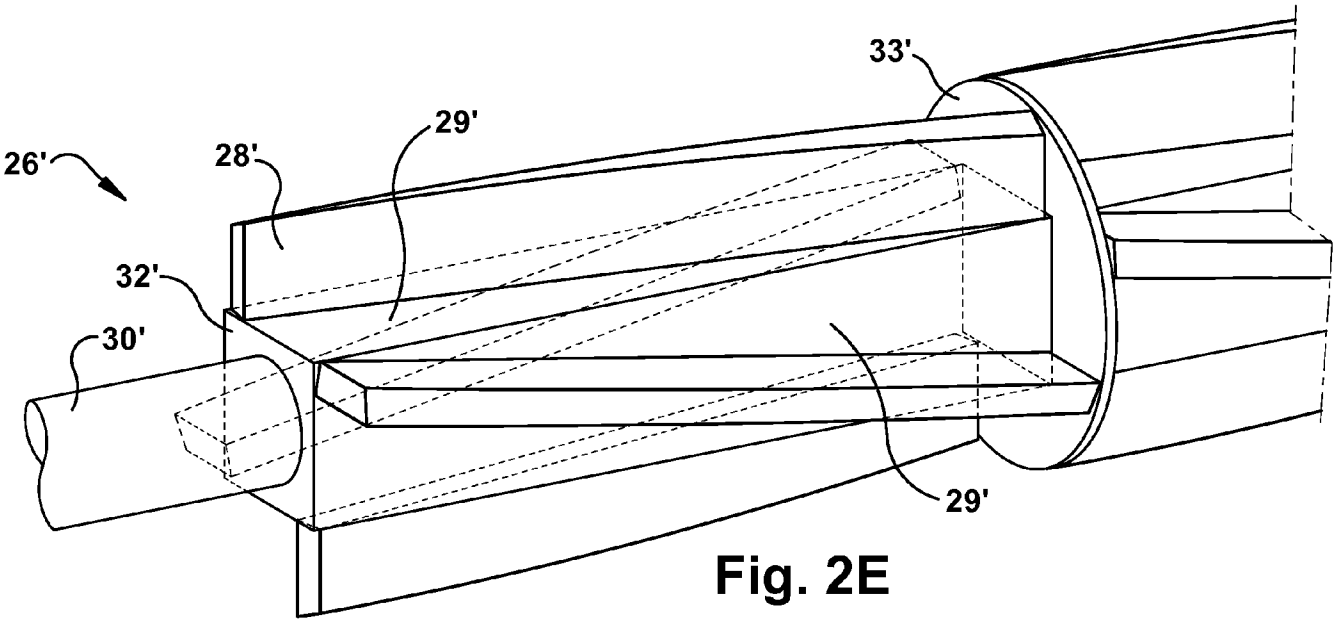
FIG. 2E is an enlarged perspective view thereof.

Axial baffles 22 of a first design (FIG. 1C) extend along their length (long dimension) along the axis X. Transverse baffles 24 extend transverse to the axis X, for example, perpendicular to the axis X, along their major dimension. Referring to FIGS. 2A-C, a rotatable agitator 26 includes multiple blades 28. In one design, the agitator 26 includes a shaft 30 and a central hub portion 32 welded to the shaft that extends in the mixing chamber along the axis X. For example, the blades 28 each have a twisted orientation on the central portion 32 of the agitator. The agitator may be referred to as having helical blades, or being a helical rotor, rotary screw or the like (such as the rotary devices used in screw compressors). For one example, see http://www.gearandrack.com/worm_worm_gears/helical_rotors.html. Other variations of the agitator may be employed. The agitator may include other features besides blades without departing from the spirit and scope of the present disclosure, for example, lobes, threads, or the like.

Figure 3A:
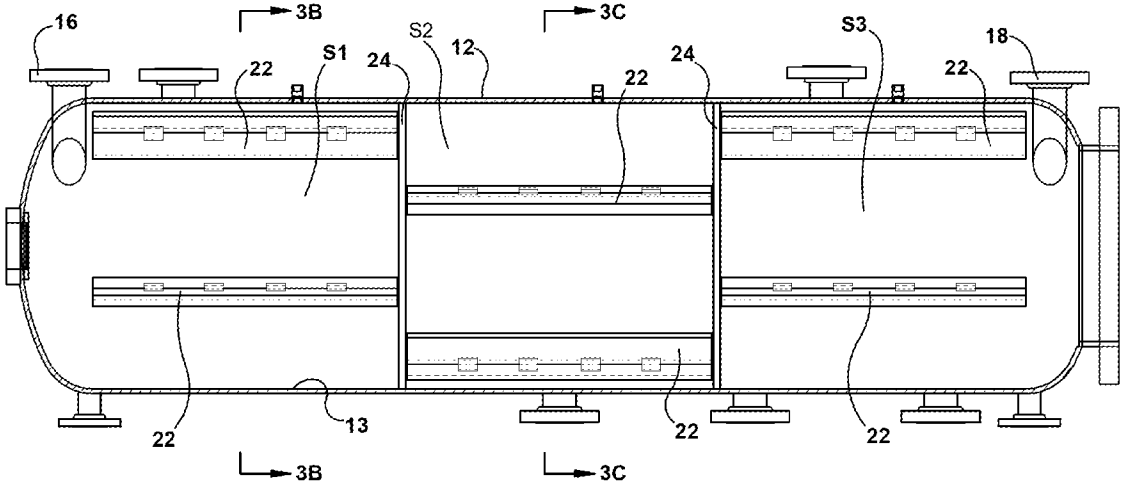
FIG. 3A is a side view of the mixing assembly showing only the axial baffles of one design.
Figure 3C:
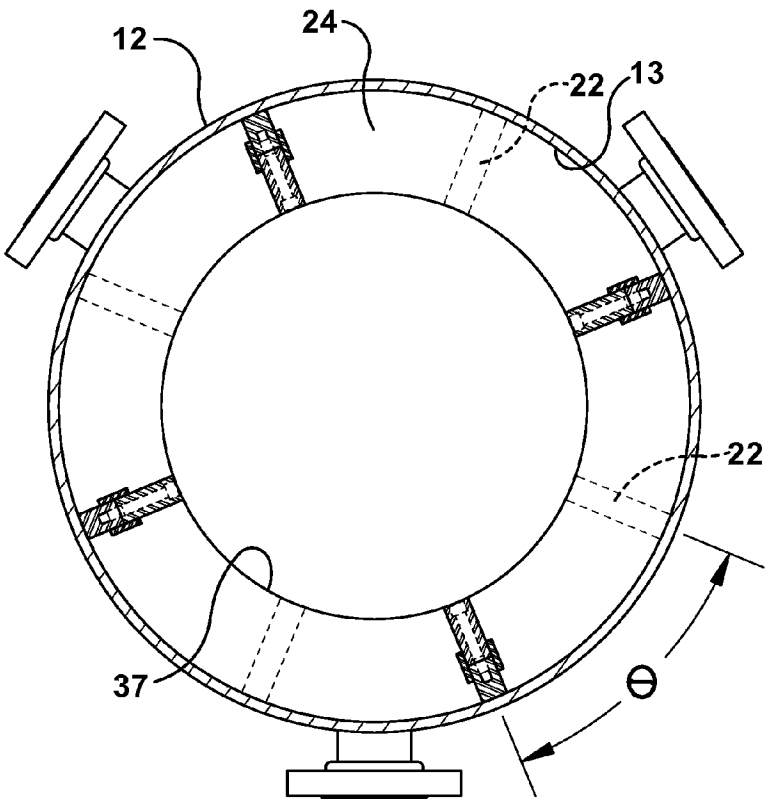
FIG. 3C is a cross-sectional view as seen along lines 3-C in FIG. 3A.

The agitator 26 includes agitator baffles 33 (FIGS. 2A-C) that extend transverse to the axis X along their major dimension and are in alignment with respective transverse baffles 24 of the mixing chamber. More specifically, the transverse baffles 24 and the agitator baffles 33 are constructed and arranged to partition the mixing chamber into at least three axial segments (e.g., S1, S2 and S3 in FIG. 3A). The agitator baffles 33 may have a circular outer edge or profile 35 (FIG. 2C) while the transverse baffles 24 may be annular and have a circular inner opening 37 (FIG. 3C). One of the agitator baffles 33 is disposed in the circular opening of a respective one of the transverse baffles. Therefore, the gaps G (FIG. 3D) between the agitator baffles 33 and the transverse baffles 24 can be annular and are relatively small compared to the inner diameter D of the mixing chamber (e.g., ⅝ inch gap G is present in a mixing chamber having an outer diameter of 2.5 feet). However, gap size G is not dependent on mixing chamber diameter.

The agitator can have twisted blades 28 in each axial segment around a circumference of the central portion of the agitator (FIGS. 2A, 2B). The twist may be referred to as a helical screw twist and the agitator shaft, central portion and blades can be similar to or the same as that of U.S. Pat. No. 6,036,355, which is directed to a previous mixing assembly design by Quantum Technologies and is incorporated herein by reference in its entirety.

Figure 2G:
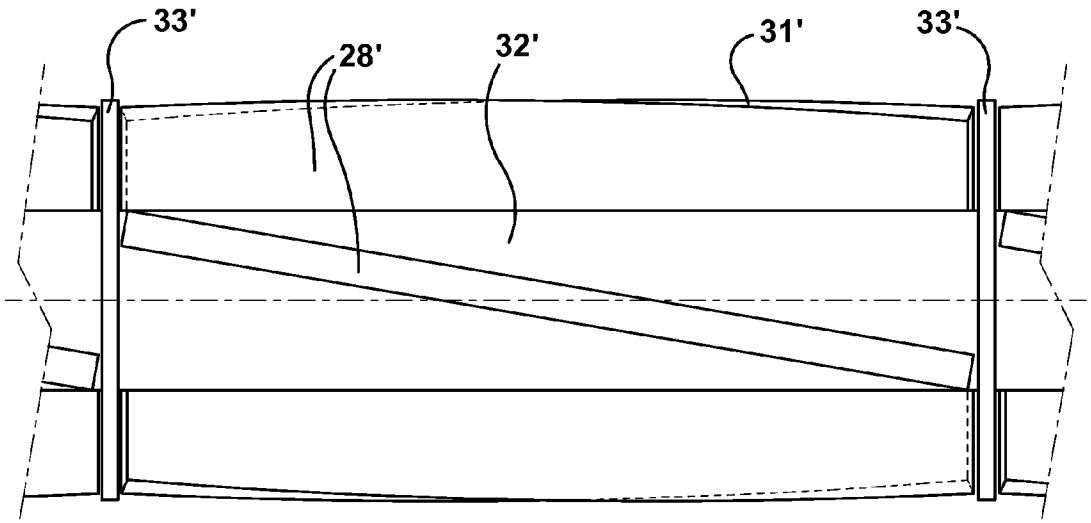
FIG. 2F is an end view thereof and FIG. 2G is an enlarged front view thereof.
Figure 2F:
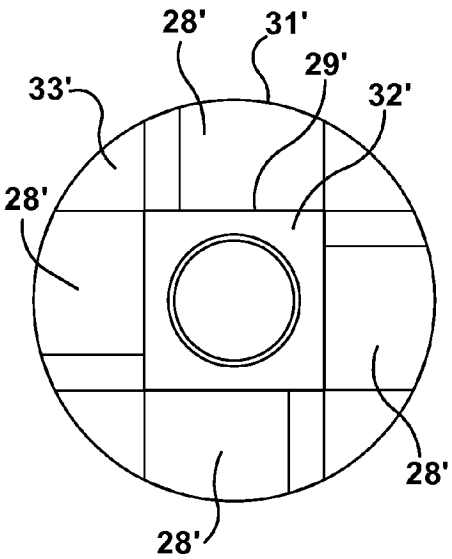

In another variation (FIGS. 2D-2G), the agitator 26' includes flat faces 29' and straight blades 28' extend diagonally along the faces in a direction of a length of the agitator. The blades can include an outer arcuate surface 31' (FIG. 2F and FIG. 2G). The agitator 26' includes agitator baffles 33'. This agitator 26' also may achieve movable venturis in the space S discussed in more detail below and function similar to the agitator with twisted blades described in this disclosure. This agitator may be used in all aspects of the mixing assembly of this disclosure.

The blades 28 on the present agitator in each segment are axially spaced from the blades in another segment. All of the fluid (including gas, liquid and any solids) in the mixing chamber must pass through the relatively small gaps G, which introduces unique fluid flow inside the mixing chamber, and improved mixing and reaction of the solid, liquid and gas.

Figure 3B:
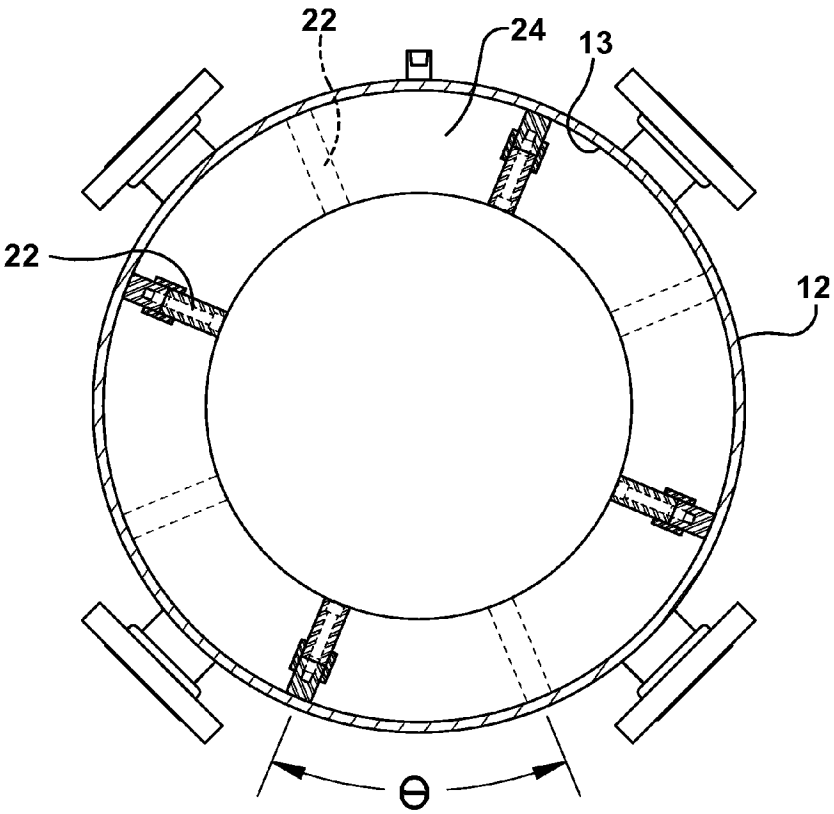
FIG. 3B is a cross-sectional view as seen from lines 3-B of FIG. 3A.
Figure 3D:
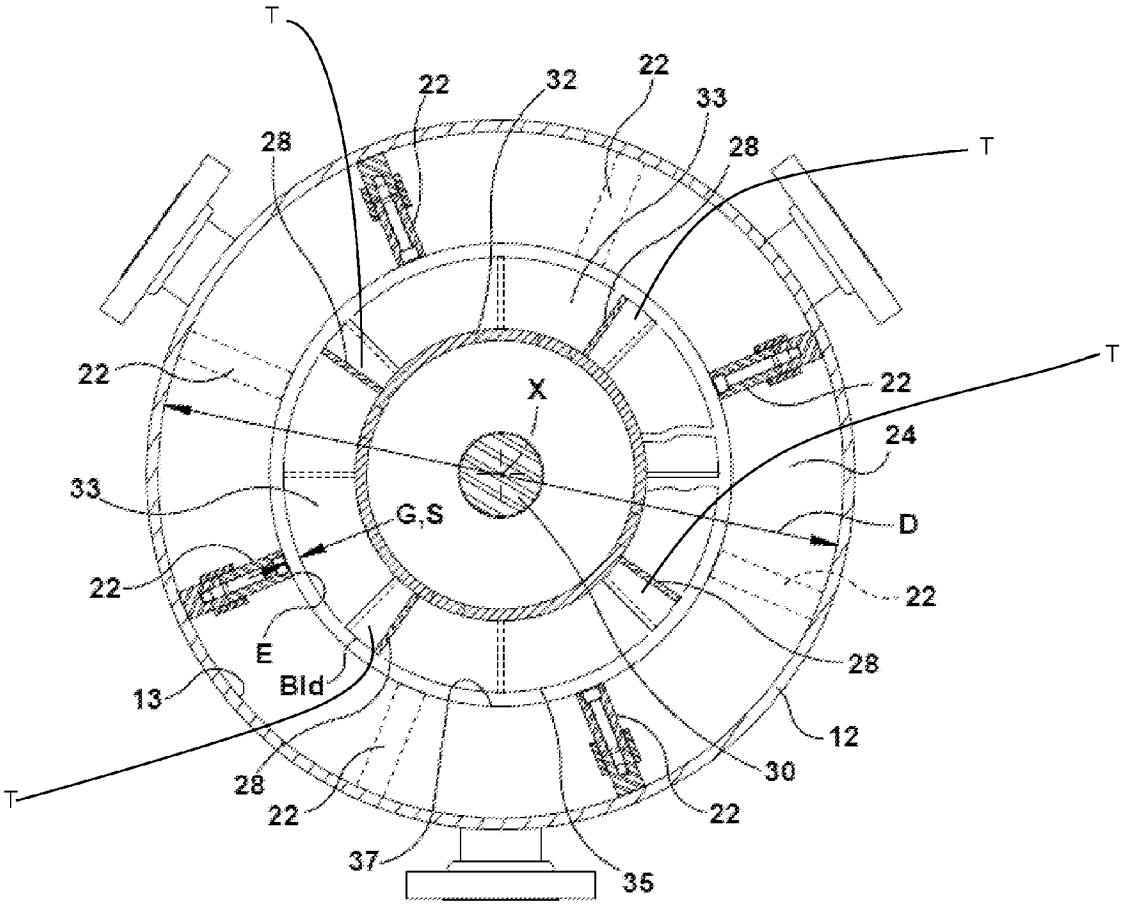
FIG. 3D is an enlarged cross-sectional view of the mixing chamber and baffles.

While not wanting to be bound by theory, it is believed that forcing gas bubbles and liquid in the space S (FIG. 1C) between the axial baffles 22 and outer peripheral edge of the agitator blades 28 causes cavitation or implosion of the bubbles at very unusual conditions of changing pressure and very high temperature, which contributes to the extremely efficient and rapid mixing inside the dynamic mixing assembly. This space S is shown as a representation in FIG. 2B where a blade tip of a twisted blade is closest to the axial baffle, for purposes of illustration only, rather than the exact location of the axial baffle in the mixing chamber. The space S exists along the length of the axial baffles in each segment. As shown in FIG. 3D the space S and gap G can be the same shape and radial size, but at different axial locations and different axial lengths. The space S is located along a length of each axial segment between the twisted blade tips and axial baffles but not at a location of the transverse baffles, while the gaps G are located only between the aligned agitator baffle and respective transverse baffle across an axial thickness of these baffles. Also, the gap G is a constant annular opening defined by the presence of the transverse and agitator baffles, while the space S is not constantly present at all times for the entire length of an axial baffle; it is only functionally present when a blade tip passes closest to an adjacent one of the axial baffles 22.

While not wanting to be bound by theory, it is believed that the space S between the outer periphery of the agitator blades and axial baffles create what in effect may be considered a plurality of moving venturis along the length of the mixing chamber. That is, there is believed to be an area of low pressure in the space S such that gas bubbles passing through the space S quickly increase in size while there and then collapse after leaving the space and entering a higher pressure environment. The twisting and offset of the blades 28 or construction of agitator with blades 28' is believed to result in the venturis continually moving axially along the length of the axial baffles 22 (e.g., from the leading end of the axial baffles toward the downstream axial end of the axial baffle and then as the agitator rotates, beginning again with the next blade at the leading end of that axial baffle and moving along its length).

The central hub portion 32 of the multibladed agitator extends into the interior of the mixing chamber along the axis X. Those skilled in the art will realize in view of this disclosure that the hub portion may be formed integrally with the shaft, formed separately from the shaft or otherwise omitted. For example, the blades may extend directly from a cylindrical shaft with no hub portion. It should be appreciated that any central hub portion of the agitator is fluid impermeable. In addition, as is apparent from the drawings, the mixing chamber can be, for example, imperforate along its length except for the at least one fluid inlet, the gas inlets and the at least one outlet. This does not exclude providing access openings in the mixing chamber for maintenance. Also, the flowable material travels in general along the axis X from the inlet toward the outlet and during this travel all flowable material in the mixing chamber is forced to pass through the small gaps G. It should be appreciated by one skilled in the art in view of this disclosure that although the material before being inlet into the mixing chamber is referred to as "flowable material," and the material inside the mixing chamber is also referred to as "the flowable material," this description is not intended to describe its composition because reactions occur to the flowable material inside the mixing chamber leading to the delignified pulp mixture that leaves the mixing chamber.

The agitator baffles maintain a fixed position despite rotation of the agitator and their own rotation. This is believed to contribute to the effectiveness of the moving venturis and cavitation inside the mixing chamber by making more gas available in this mechanism. Substantially axial fluid flow of, for example, gas will be inhibited near the agitator and will be directed outwardly by the agitator baffles (e.g., $A_2$ in FIG. 2A), which is believed to make more gas available for reaction. Substantially axial fluid flow will be inhibited by the transverse baffles which direct the material inwardly (e.g., $A_1$ in FIG. 2A). Circumferential flow of material is inhibited by the axial baffles (e.g., $C_1$ in FIG. 4D). Forcing the material (e.g., 43, FIG. 2A) to pass through the small gaps G (e.g., F in FIG. 2A) is also believed to increase residence time and the extent of reaction of material in the mixing chamber.

Referring to FIGS. 1A and 2A, the inlet 16 communicates with the mixing chamber in such a way that the flowable material 38 from the inlet 16 enters the mixing chamber. The inlet 16 is a conduit or pipe that is of sufficient size to admit the desired flow rate of the flowable material. The flowable material 38 may be pumped under pressure at a particular flow rate into the mixing chamber by a pump P1 (FIG. 2A). The flowable material 38 includes aqueous liquid paper pulp 40 as a first component. The basic compound is a second component 42 of the flowable material 38 and is selected from the group consisting of: oxidized white liquor, oxidized green liquor, sodium bicarbonate, sodium hydroxide, a peroxide compound, ozone and combinations thereof. A third optional component of the flowable material 38 at this location is oxygen-containing gas 44. The white liquor may be oxidized so as to contain $Na_2S$ in an amount less than 1 g/l and in particular in trace amounts. A fourth optional component of the flowable material 38 is steam Stm.

In one aspect, the first aqueous fluid paper pulp component 40, the second basic compound component 42, the third oxygen-containing gas component 44 optional at this location and the fourth optional steam component Stm may be combined together in a mixer Mx and the mixture then travels along conduit to the inlet 16 of the mixing chamber. This is shown in dotted lines in FIGS. 2A and 5 as it is one version of the flowable material components and how they may be combined together.

The oxygen-containing gas can be mixed with the aqueous pulp liquid before it is inlet into the mixing chamber, it can separately be directed into the at least one gas inlet 20, or combinations thereof. In all aspects of this disclosure the oxygen-containing gas has a composition selected from the group consisting of the following gas: $O_2$, $CO_2$, $O_3$, steam, inert gas and combinations thereof.

In another aspect, (FIGS. 1 and 5) the first aqueous paper pulp component 40 may be pumped along a conduit 41 (represented as a line between the pump P1 and an optional venturi V). The optional fourth component steam Stm may already have been combined with the aqueous pulp fluid at this point so as to increase its temperature. The second fluid component 42 may be pumped along conduit 43 with pump P2. The venturi V may admix the second component basic compound fluid 42 into the first component fluid 40 and optional fourth component steam Stm, resulting in the fluid 38 that enters the mixing chamber. The oxygen containing gas 44 as the third component of the flowable material can optionally be directed along conduit 45 into a header 46 and conduit 48 leading to each optional gas inlet 20 (FIG. 1A). The gas can travel to gas insert assemblies of the gas inlets 20 as described, for example, in the U.S. Pat. No. 6,036,355 and U.S. Pat. No. 5,607,233, which can affect the bubble size and flow rate of the gas. The gas inlets 20 may be positioned at various locations around the mixing chamber. A gas source containing the gas may be employed and is in fluid communication with the mixing chamber. Conduit, valves, mixing devices and pumps may be used when transporting the components of the flowable material to the mixing chamber as would be appreciated by those skilled in the art. A conduit 50 leads away from the outlet 18 of the mixing chamber. After the mixing of the flowable material and the short delignification reaction and dissolving of the lignin in the mixing chamber, the delignified paper pump mixture 52 leaves the mixing chamber via the exit pipe 18 and the conduit 50 (FIG. 2A).

Figure 1D:
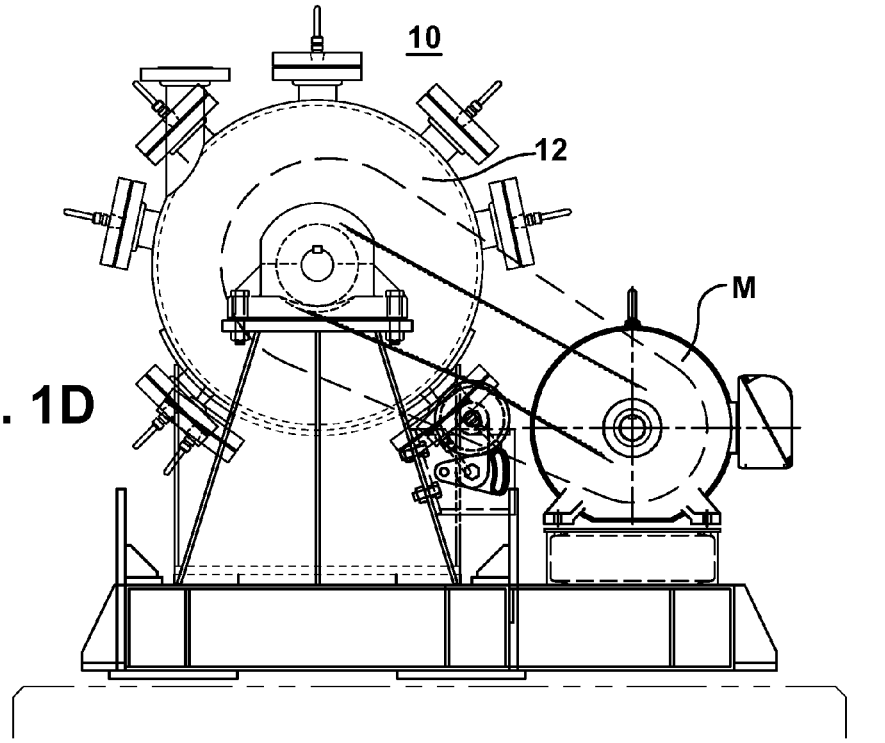
FIG. 1D is a left side view of FIG. 1A.

Referring to FIGS. 1A-D, the agitator 26 is driven by a suitable external drive mechanism M and the shaft 30 is coupled to the motor in a manner known to those skilled in the art, for example, a motor driven belt drive (FIG. 1D). The shaft is supported by an appropriate bearing assembly and pillow blocks known in the art. The mixing chamber is supported by suitable supports. The rotating shaft is sealed and supported in the mixing vessel by suitable sealing and bearing devices. The sealing devices are preferably dual-face rotating mechanical seals, although any suitable sealing mechanism may be used.

The unique fluid flow and high reactivity inside the mixing chamber are believed to give rise to areas of intense temperature, which heats the mixing chamber and/or the agitator shaft, and may lead to differences in thermal expansion. Therefore, it is advantageous to design at least one of the seals and bearings, for example, the seal and bearing at the outlet of the mixing assembly, to be movable in response to temperature such as through the use of one or more springs or suitable structure. Those skilled in the art would be able to design a suitable such movable, temperature responsive seal and bearing in accordance with this disclosure.

Referring to FIG. 2A, more specifically, at least two of the transverse baffles 24 and at least two of the agitator baffles 33 are employed. The transverse baffles 24 have, for example, an annular shape and extend perpendicular to the longitudinal axis (FIG. 3D). The transverse baffles 24 include a circular opening 37 in their center. The agitator baffles have a circular outer perimeter 35 and are positioned in alignment with the transverse baffles inside the circular opening forming the gaps G between them. The transverse baffles 24 are fastened to the interior wall 13 of the mixing chamber 12 and, along with the aligned agitator baffles, partition the reactor into three or more axial segments. The transverse baffles 24 disrupt the bulk flow of fluid in substantially the axial direction, substantially lessening the possibility of fluid flowing axially through the chamber undermixed. The transverse baffles 24 force the bulk flow of fluid generally radially inwardly toward the agitator blades 28 to ensure complete mixing, and to form a liquid barrier through which gases cannot pass unobstructed.

The axial baffles 22 of the first design (FIGS. 3A-3D) extend substantially radially inwardly from the interior wall 13 of the mixing vessel and disrupt substantially circumferential fluid flow within the individual axial segments. As shown in FIGS. 3A and 3B, the axial baffles in one of the segments S1 are offset by an angle theta from the axial baffles in an adjacent one of the segments S2 as viewed in a direction of the axis X (the axial baffles in the downstream segment being shown in dotted lines). Similarly, as shown in FIGS. 3A and 3C, the axial baffles in one of the segments S2 are offset by an angle theta (θ) from the axial baffles in an adjacent one of the segments S3 as viewed in a direction of the axis X. The angle theta ranges from about 0 degree to about 180 degrees and, in particular, is not greater than about 90 degrees. The axial baffles 22 extend substantially the entire length of each axial segment. In a given axial segment the axial baffles may be circumferentially spaced apart from each other by a central angle ranging from about 0 degrees to about 180 degrees. The baffles are specifically symmetrically equally spaced around the circumference of the mixing chamber in each segment. For example, when four axial baffles are used in a segment the axial baffles are spaced apart from each other by about 90 degrees. This baffle design may be aggressive when used on paper pulp in that it may chop fibers and reduce strength of the paper.

In one example design, the mixing chamber is about 20 inches in internal diameter and about 6 feet long, for example. This can be scaled up in size for pulp mill operation. For example, the mixing chamber can have an internal diameter on the order of 5-8 feet while the length of the mixing chamber can be 12-28 feet long.

Referring to FIG. 3D, one version of the blades 28 are advantageously twisted as shown, although other degrees of twist (pitch) and numbers and locations of blades are within the scope of the present disclosure. In particular the blades may extend perpendicular to a tangent to the cylindrical hub portion 32 as the blades twist, throughout the length of the blades. The blades can have a constant height outwards from the hub portion to the peripheral edge or tip, through an entire length of each blade. For example, four blades are disposed on the central portion in each axial segment, each spanning about 90 degrees of the central portion. As shown in FIG. 3D, the blades have a pitch such that the space S is located between each blade tip Bld (when it is adjacent or closest) to edge E along the twist T for the entire length L of the blade as it is rotated past that axial baffle. It should be apparent that due to the blade twist not all blade tip portions are located adjacent the edge E of an axial baffle at the same time. The blade twist T lessens momentary power peaks that a blade parallel to the axis X would be prone to, and it creates a means to either propel the fluid from the mixing chamber or to retard the flow of fluid from the chamber. Thus, when the agitator is operated in accordance with the present disclosure, the twisted blades affect residence time of liquid material within the mixing chamber. The axial length of each agitator blade can be approximately equal to that of each axial baffle. The twisted blades may be used in all aspects of this disclosure including the second axial baffle design.

In the first design (FIGS. 3A-3D) the axial baffles 22 extend substantially parallel to the longitudinal axis X along their length and are exposed to the fluid on both sides of each axial baffle. The length of the first design of axial baffle extends along axis X and the width or height extends radially inwardly and is exposed on two sides to the flowable material.

A variation of the axial baffles of a second design is shown in FIGS. 4A-4D. The axial baffles 56 or baffle assembly of the second design include a plate 58 and support legs 60. The support legs fasten the plate to the interior wall 13 of the mixing chamber. The legs may be welded or otherwise fastened to the interior wall. Here, the width of the plate 58 extends transverse to an orientation from the interior wall radially inward. The plate 58 of one of the baffle assemblies is diametrically opposed from the flat plate of another of the baffle assemblies in that axial segment (e.g., FIG. 4B). Only one side of the plate 58 is contacted with the flowable material inside the mixing chamber. The baffle assemblies of one segment can be offset relative to the baffle assemblies of an adjacent segment (compare FIGS. 4A, 4B to FIGS. 4A, 4C). This axial baffle design 56 is believed to have less of a chopping effect on pulp fibers and may advantageously reduce fiber strength less compared to the first axial baffle design.

Figure 4A:
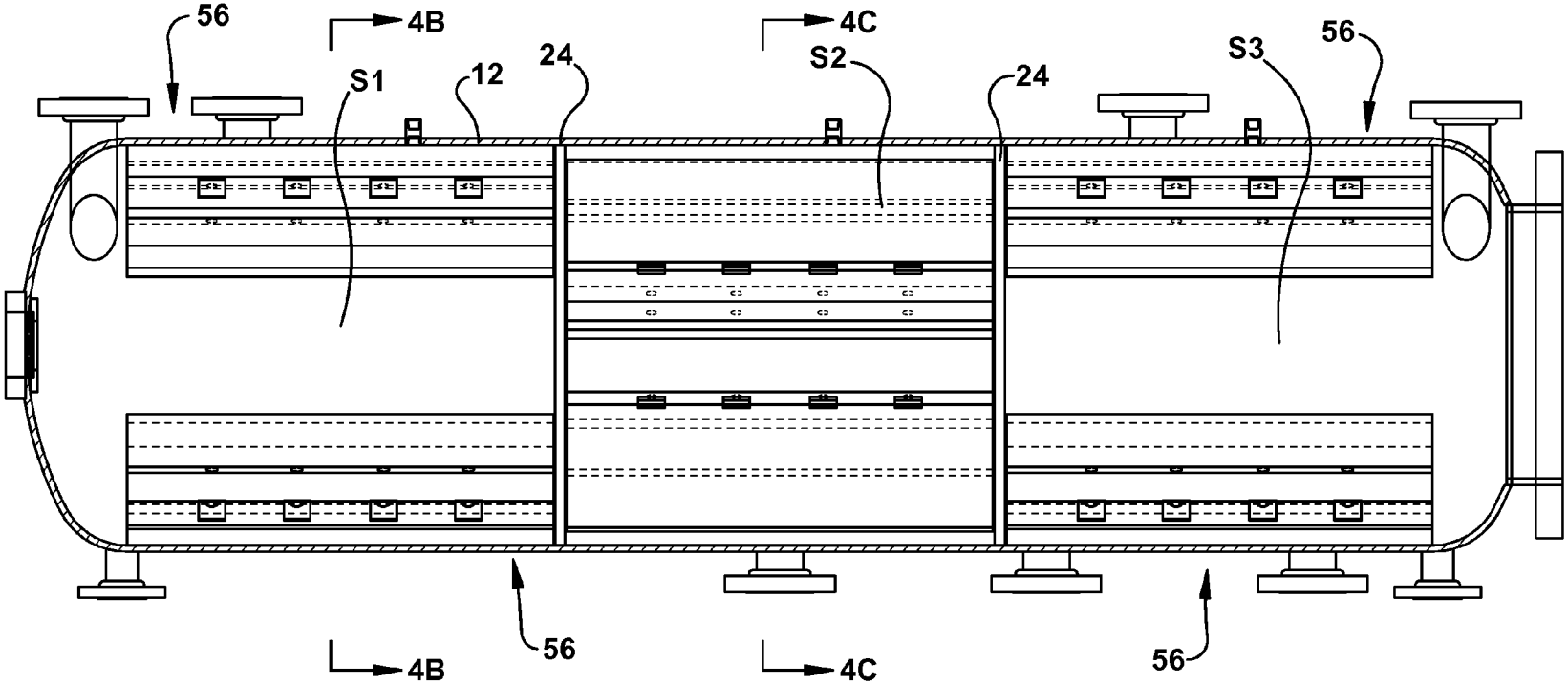
FIG. 4A is a side view of the mixing assembly including a different design of axial baffles.
Figure 4C:
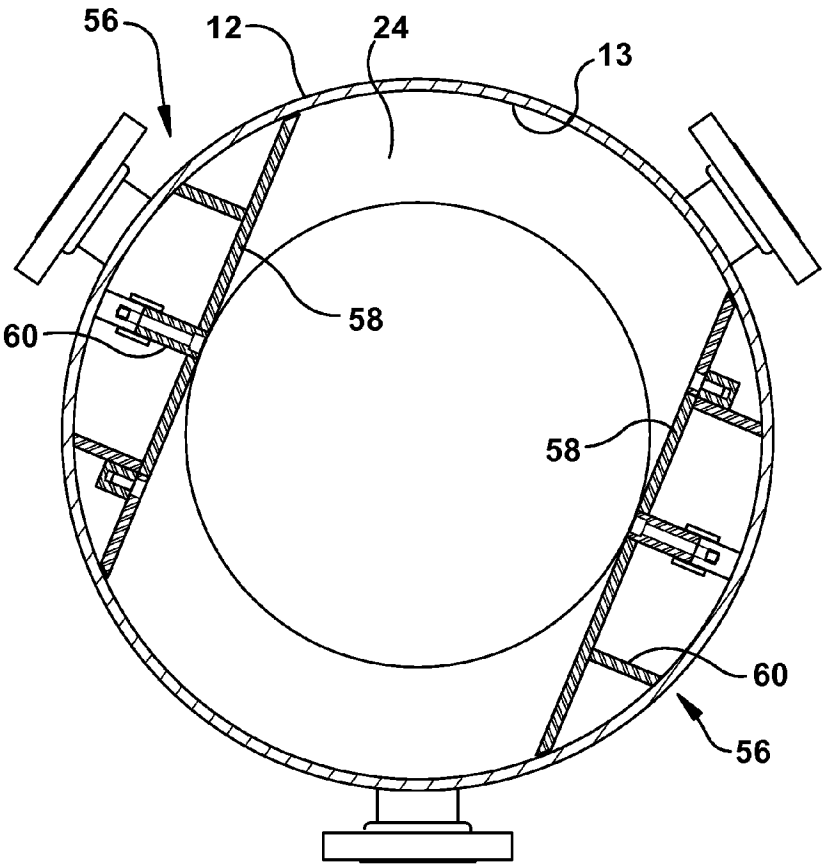
FIG. 4C is a cross-sectional view taken from lines 4-C of FIG. 4A.
Figure 4B:
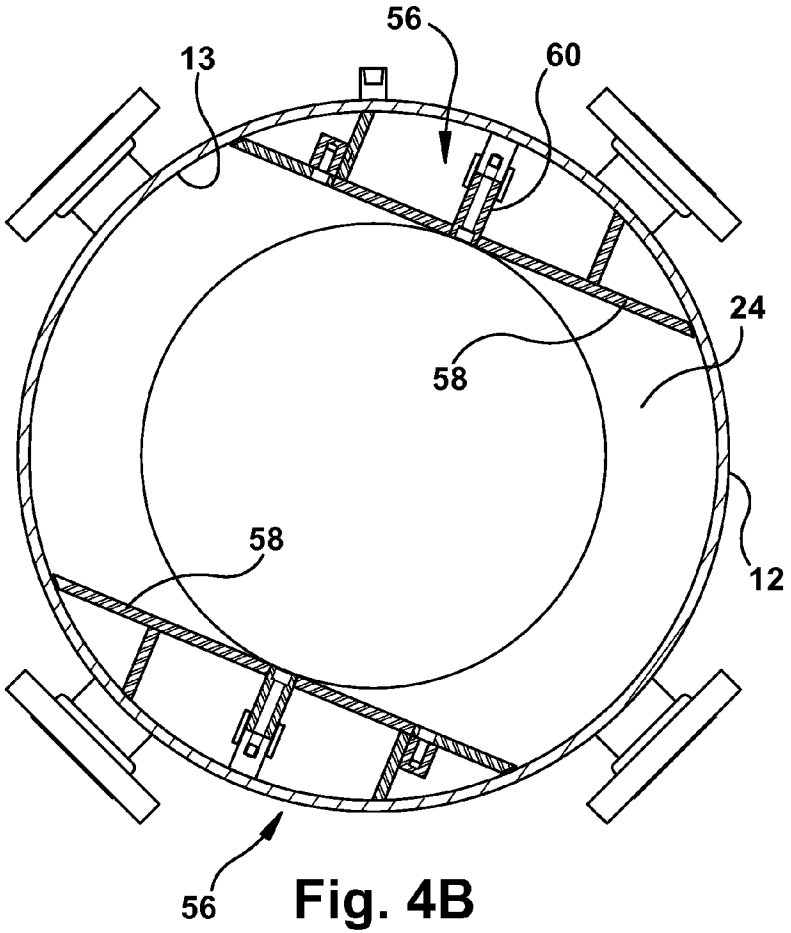
FIG. 4B is a cross-sectional view taken from lines 4-B of FIG. 4A.
Figure 4D:
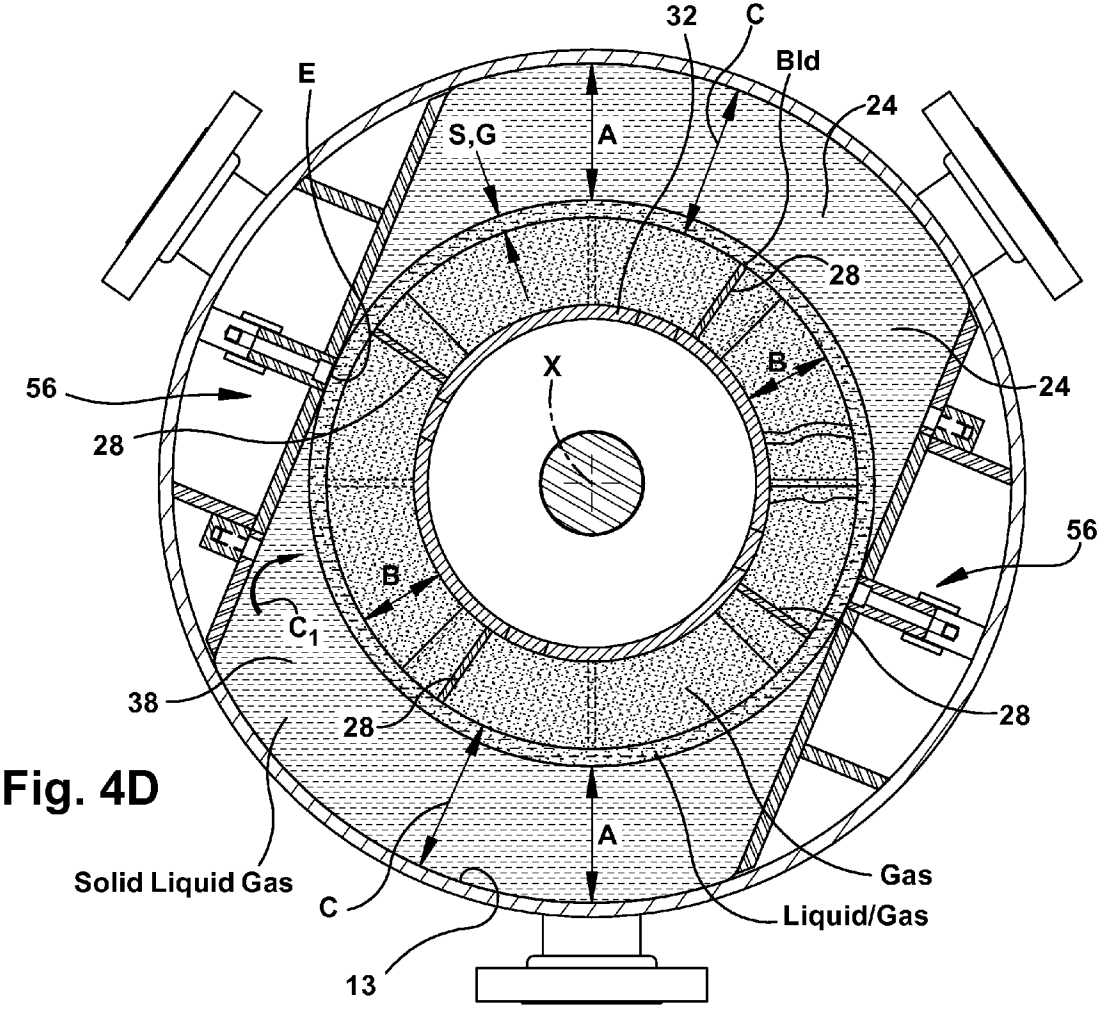
FIG. 4D is an enlarged cross-sectional view of the mixing chamber and baffles, including possible locations of components of flowable material in the mixing chamber.

Referring to FIG. 4D, while not wanting to be bound by theory there are believed to be three fluid zones in the mixing chamber as viewed cross-sectionally in a direction of the axis X. The flowable material 38 includes the oxygen containing gas, the paper pulp fluid (e.g., a suspension of the paper pulp in a fluid which may be an aqueous fluid), the optional steam and the fluid of the basic compound. Upon rotation of the agitator the centrifugal forces imparted by the blades on the fluid in the mixing chamber are believed to cause primarily liquid and any solid material to reside in an outer zone A located in an annulus radially between the interior wall surface 13 and the inner edges E of the axial baffles. Predominantly gas is believed to be located in an innermost zone B located in an annulus that extends radially outwardly from the central hub portion 32 to the outer edges Bld of the blades. A reaction zone C is believed to be located radially between the outer liquid material zone A and the inner gas zone B in the generally annular space S and gap G, all the way to the interior wall of the mixing chamber. The reaction zone C contains a mixture of liquid, solid and gas. Gas will be disposed in the outer region and some liquid may be disposed in the inner region. All of the flowable material components will be disposed in the gaps G as they must travel through them. The composition of the fluid may change along the axial segments of the mixing chamber as more mixing and reaction occurs as the fluid travels along the length of the mixing chamber toward the outlet. That is, bonds between the lignin and cellulose in the fluid that enters the mixing chamber are progressively broken, and lignin is dissolved, as the flowable material travels along the length of the mixing chamber. In addition, while not wanting to be bound by theory, the oxygen in the gas that enters the mixing chamber may result in formation of free radicals that may participate in the delignification reaction.

In contrast to conventional mixing reactor towers used for delignification of paper pulp, inside the mixing chamber of the present dynamic mixing assembly there is a much higher ratio of gas to fluid. That is, much less fluid occupies the mixing chamber volume compared to the fluid inside a typical tower. For example, the ratio of fluid volume to gas volume inside the mixing chamber before oxygen is absorbed is on the order of 3:1.

The size of the reaction zone C can produce a particular relatively short residence time of liquid material in the mixing chamber. When the size of the reaction zone C is increased, the liquid material will have a longer residence time in the mixing chamber. When the size of the reaction zone C is decreased, the liquid material will have a shorter residence time in the mixing chamber. Moreover, the gaps G lengthen the time the fluid and gas spend in the mixing chamber and avoid unreacted oxygen in the gas. In addition, the size of the space S can affect the extent by which cavitation occurs inside the mixing chamber. Referring to FIGS. 3D and 4D, one can see that the entire volume of fluid that is continuously being fed into the mixing chamber will pass through the relatively small gaps G. In addition, fluid and gas inside the mixing chamber travels through the spaces S between the outer peripheral edges of the agitator blades and the axial baffles.

The relative sizes of the zones A, B and C may be adjusted mechanically or operationally. Their sizes and locations are only shown for purposes of illustration in FIG. 4D). One should appreciate the zones A, B and C would be present in similar locations in FIG. 3D which employs the first design of the axial baffles. The size of the space S and gap G may be determined when the reactor mixer is designed, by adjusting the size or height of the blades and the width of the axial baffles of the first design (or inward location of the axial baffle plate in the second axial baffle design) as well as the inside diameter of the mixing chamber.

The drive M can rotate the agitator clockwise or counterclockwise. The drive is preferably a variable speed drive that can be operated to rotate the agitator slowly or quickly. Those skilled in the art will appreciate in view of this disclosure that the relative values of "fast" or "slow" rotational speed of the agitator and the effect these values and rotational direction have on liquid residence time in the reaction zone, can be empirically determined for each first component, second component, etc. fluid system.

In operation, first fluid material, including the paper pulp fluid, steam and the basic liquid, for example, white liquor, in particular, oxidized white liquor, is directed through the fluid inlet at a certain flow rate into the mixing chamber. White liquor may have any composition known to those skilled in the art, including, but not limited to sodium hydroxide, sodium sulfide and impurities that vary from mill to mill. Oxygen-containing gas is directed along headers, through the gas inlets 20 into the mixing chamber. The oxygen-containing gas can be selected of different compositions having varying amounts of oxygen and air, for example, 90-94% $O_2$, with the balance being inert gas, all the way up to 100% $O_2$. An amount of $CO_2$ that is added is that which is sufficient for pH control to a desired level. The agitator rotates at a particular speed and direction depending upon the desired residence time of fluid material in the reactor mixer e.g., at least 60 rpm. Fluid flow is disrupted generally circumferentially in the mixing chamber by the axial baffles. Fluid flow is disrupted in a direction substantially along the axis (axial direction) by the transverse baffles and gas flow is disrupted along the axial direction by the transverse agitator baffles. The fluid and gas inside the reactor is forced to pass through the spaces S between the agitator blade tips and the axial baffles as well as through the gaps G between the agitator baffles and transverse baffles. The fluid and gas are reacted in the mixing chamber so as to break bonds between the lignin and the cellulose of the paper pulp. Lignin degradation products may or may not exist in the mixing chamber depending on the basic compound that is used, but it is believed they will be dissolved by the alkali in the delignified pulp mixture that leaves the mixing chamber. The bonds between the lignin and cellulose of the paper pulp are broken and possibly also the bonds of the lignin polymer are broken resulting in a delignified paper pulp mixture. The delignified paper pulp mixture leaves the mixing chamber through the outlet.

The operating parameters of the system vary according to the dimensions and end use of the system, as well as many other factors. For purposes of illustration only, the mixing system can process from 0.1 to 500 gallons per minute of the flowable material, so as to delignify the paper pulp within pulp mill operations. The mixing chamber is capable of containing pressures up to 250 pounds per square inch gauge, for example. The blade speed depends upon the geometry of the agitator and the degree of mixing required.

The paper pulp, oxidized white liquor, steam and the oxygen containing gas are intensively mixed in the pressurized high intensity mixing assembly, and the through put rates of the delignified paper pulp are such that the reaction is exothermic The reaction is rapid and requires a very short residence time in the present mixing assembly.

The solid/liquid/gas mixing assembly must be capable of high intensity mixing of the oxygen-containing gas and the liquid such that it promotes a chemical reaction between the lignin of the paper pulp and the oxygen or radicals produced by the oxygen. Accordingly, it will have a high through-put rate and a short residence time, a device for producing small oxygen gas bubbles (e.g., insert assemblies of the U.S. Pat. No. 6,036,355) and the agitator and baffle design that intensively mix the gas and liquid.

The mixing assembly is adapted to mix components under pressure. More specifically, the mixing assembly provides violent mixing of the paper pulp, white liquor, steam and oxygen-containing gas under a pressure greater than atmospheric pressure.

For example, when pumped into the mixing chamber, the pulp is at 10% consistency (weight of pulp solids relative to a total weight of the mixture, exclusive of the steam and the fluid of the basic compound), and is at 60-100 degrees C. received from the mill. The alkali sources pumped into the mixing chamber are selected form the group consisting of NaOH, oxidized white liquor, ozone, oxidized green liquor, a peroxide compound, sodium bicarbonate and combinations thereof. The oxygen containing gas (e.g., including $O_2$ and/or $CO_2$) is directed into the mixing chamber at a rate of, for example, 150-200 scfm or in a scaled up mixing assembly, at a rate of, for example, 1500-2000 scfm. The pressure of the oxygen-containing gas (oxygen and/or CO2) may range, for example, from atmospheric pressure to about 350 pounds per square inch gauge ("psig"). In particular, the pressure of the oxygen-containing gas may range, for example, from about 50 to about 350 psig and from about 50 to about 200 psig, and about 150 psig. The oxygen-containing gas may have a composition, for example, of 90-94% $O_2$, with the balance being inert gas, all the way up to 100% $O_2$. Heat from an external heat source is added to the system to speed up the delignification reaction (e.g., using steam or hot liquid basic compound). Exit temperatures of the delignified pulp mixture may range from 110 degrees C. to about 200 degrees C., for example. The delignified paper pulp mixture leaving the mixing chamber travels to a tank from which it is degassed to as to release any unreacted oxygen gas and inert gas.

The aforementioned operating conditions result in reduced residence times of the material in the mixing assembly. In this respect, residence time in the mixing chamber ranging from about 30 seconds to about 2 minutes can be achieved. In another aspect, residence times ranging from about 10 seconds to about 2 minutes can be achieved. It will be appreciated that the residence time of the liquid pulp material may vary depending on the volume of the reactor and the inlet flow rate into the mixing chamber. An entire process from combination/mixing of the flowable material components, inlet of the components into the mixing chamber, residence time of the flowable material in the mixing chamber, outlet of the material from the mixing chamber and degassing, can occur in not more than 10 minutes.

Figure 5:
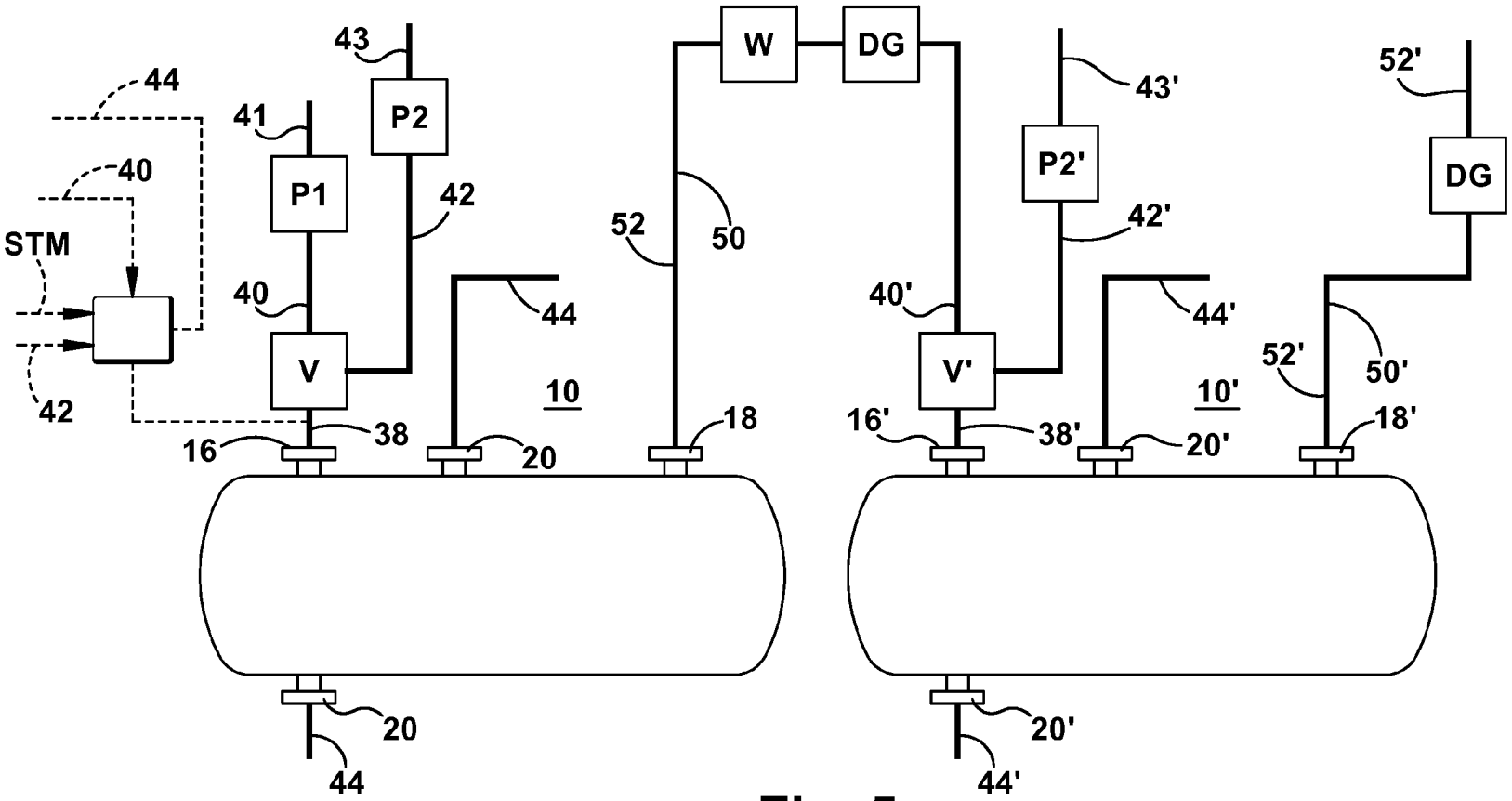
FIG. 5 shows a schematic representation of two mixing assemblies in series used in the method of this disclosure.

Another aspect of this disclosure is to construct and arrange two mixing assemblies in series as shown in FIG. 5. The components of the second mixing assembly are the same or similar to those of the first assembly of FIGS. 1-4 with like parts receiving like reference numerals throughout the views. This permits a first oxygen delignification to be carried out in the first mixing assembly 10 and a second or further delignification to be carried out in the second mixing assembly 10'. Optional further flowable material including a basic compound 42' (e.g., oxidized white liquor, ozone, a peroxide compound and/or other component described above), the oxygen-containing gas (e.g., $O_2$, $CO_2$, inert gas, steam, $O_3$) may be fed into the delignified fluid mixture 52 leaving the first mixing assembly 10, as part of the flowable material 38' entering the second mixing assembly 10'. In addition, optional steps may take place between the mixing assemblies including separating and washing of the paper pulp represented schematically by W and degassing represented by DG, before passing the delignified paper pulp mixture from the first mixing assembly 10 into the second mixing assembly 10' as flowable material 40'. An optional venturi V' may be used to add further components of the flowable material. The kappa number of the paper pulp of the mixture 52' leaving the second mixing assembly 10' is reduced compare to the kappa number of the paper pulp of the mixture 52 leaving the first mixing assembly 10. The delignified paper pulp mixture 52' leaving the degasser DG may have a reduction in kappa number of at least 50% compared to the paper pulp entering the first mixing assembly 10, in particular 50 to 80% reduction in kappa number, or an even greater reduction in kappa number.

It should be appreciated that the oxygen delignification occurs after digestion of wood chips in the kraft process and may replace the conventional tower oxygen delignification process. All aspects of this disclosure may be suitable for use in other paper mill operations besides the kraft process.

Figure 6:
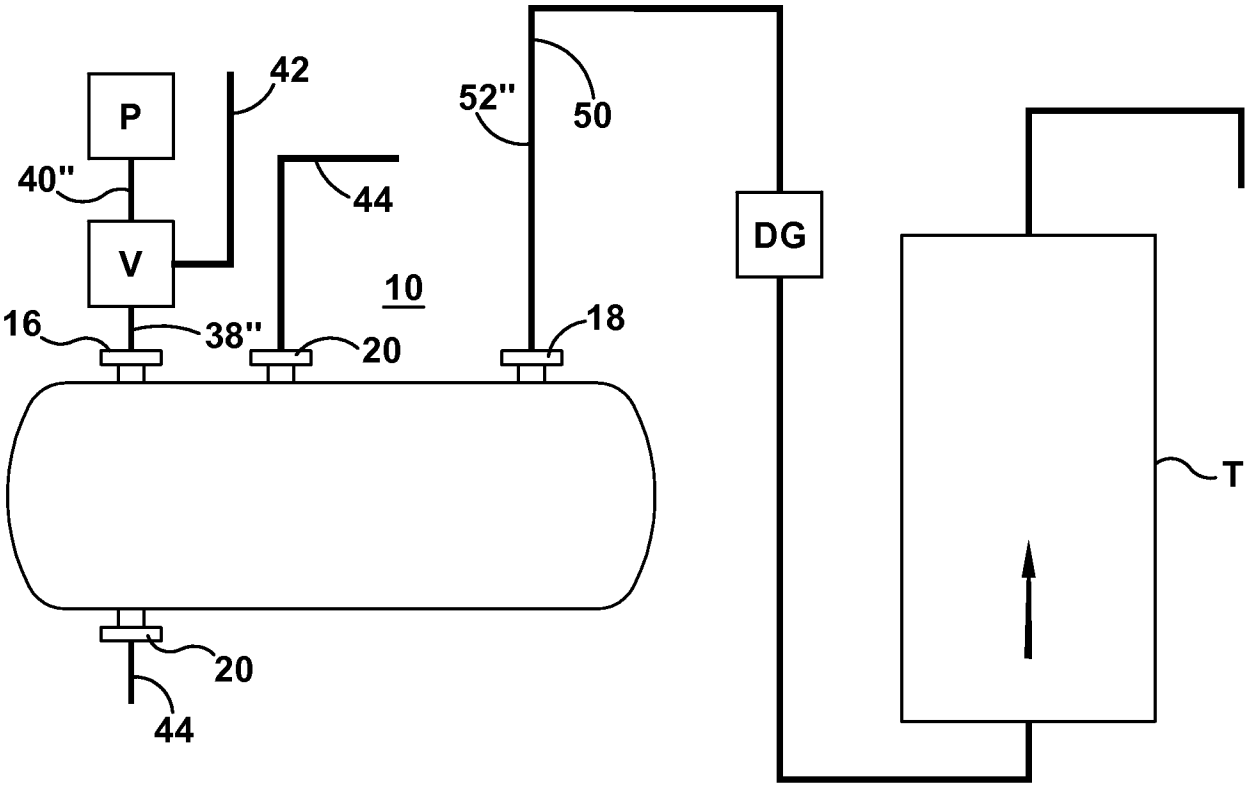
FIG. 6 shows a method of short oxygen delignification in the mixing assembly of this disclosure followed by oxygen delignification that occurs in a conventional hollow tower delignification apparatus.

Another aspect of the disclosure shown in FIG. 6 may supplement the conventional tower oxygen delignification process. In that method, the paper pulp liquid, oxygen containing gas under pressure and alkali are pumped up a hollow tower, e.g., as a pressure vessel, forming a primary delignified paper pulp mixture. The delignified paper pulp mixture is optionally washed and pumped toward the ground. It may or may not be pumped up a second such tower in series for further delignification. From there it would be optionally washed and then travel toward the ground for further processing such as degassing and bleaching. In this embodiment, the mixing assembly 10 of this disclosure is inserted between the ordinary pumped conduit of liquid paper pulp and the first delignification tower. The paper pulp is combined with the optional steam, the optional oxygen-containing gas and the fluid of the basic compound to form flowable material 38". An optional pump P and venturi V may be employed. The fluid of the basic compound may be combined with the fluid of the paper pulp using the venturi as another option. The flowable material is delignified in the mixing chamber as described above. In a variation, the oxygen containing gas may be added in the at least one gas inlet 20 separate from the fluid of the paper pulp, or with the fluid of the paper pulp, as well as in the at least one gas inlet. The delignified paper pulp mixture 52" leaving the mixing chamber is optionally degassed at DG. The material 52" is then passed directly into the bottom of the conventional hollow degassing tower, e.g., as a pressure vessel, where further delignification occurs. From the top of the tower the material may be optionally washed, optionally degassed and further treated such as in bleaching operations.

Many modifications and variations of the disclosed embodiments will be apparent to those of ordinary skill in the art in light of the foregoing disclosure. Therefore, it is to be understood that, within the scope of the appended claims, the invention can be practiced otherwise than has been specifically shown and described.

What is claimed is:

1. A short oxygen delignification method, comprising:

providing a mixing chamber having an interior wall which is substantially symmetrical about a central longitudinal axis;

providing at least one inlet for directing flowable material into said mixing chamber, wherein said flowable material includes paper pulp, a basic compound, and an oxygen-containing gas, and wherein lignin is bound to said paper pulp;

providing at least one outlet from said mixing chamber;

providing at least one axial baffle connected to the interior wall and having a length extending along said axis;

providing at least one transverse baffle connected to the interior wall and having a major dimension extending from the interior wall transverse to said axis;

wherein said at least one axial baffle extends inwardly from said interior wall so as not to extend beyond an inner periphery of said at least one transverse baffle;

providing a rotatable agitator extending along the axis including at least one agitator baffle extending transverse to said axis at a location in alignment with a respective at least one said transverse baffle, forming at least one annular gap defined by and extending between the at least one said agitator baffle and a respective at least one said transverse baffle;

bearings supporting said rotatable agitator for rotation near both ends of said mixing chamber;

directing said flowable material through said at least one inlet into said mixing chamber;

rotating said agitator inside said mixing chamber;

disrupting substantially circumferential fluid flow in said mixing chamber with the at least one said axial baffle;

disrupting substantially axial fluid flow with the at least one said transverse baffle and the at least one said agitator baffle;

forcing said flowable material inside said mixing chamber to travel through the at least one said annular gap;

carrying out a short delignification reaction in said mixing chamber so as to break bonds between said lignin and said paper pulp and to dissolve said lignin, forming a delignified paper pulp mixture; and removing said delignified paper pulp mixture from said mixing chamber though the at least one said outlet.

2. The method of claim 1 wherein said at least one inlet includes at least one gas inlet, including directing said oxygen-containing gas through said at least one gas inlet into said mixing chamber.

3. The method of claim 1 wherein said flowable material includes steam.

4. The method of claim 1 wherein a residence time of said flowable material in said mixing chamber is not more than 2 minutes.

5. The method of claim 1 wherein paper pulp in said delignified paper pulp mixture passing through the at least one said outlet exhibits at least a 50% reduction in kappa number compared to paper pulp in said fluid flowing through the at least one said fluid inlet.

6. The method of claim 1 comprising passing said flowable material tangentially through the at least one said inlet into said mixing chamber.

7. The method of claim 1 comprising passing said delignified paper pulp mixture tangentially through the at least one said outlet from said mixing chamber.

8. The method of claim 1 comprising providing a venturi upstream of the at least one said inlet and mixing in said venturi a fluid of said basic compound into an aqueous fluid of said paper pulp to form said flowable material which is then passed through said at least one inlet into said mixing chamber.

9. The method of claim 1 wherein said blades are twisted along said axis, comprising rotating said agitator in said mixing chamber.

10. The method of claim 9 comprising at least two of said transverse baffles and at least two of said agitator baffles, wherein said aligned transverse baffles and said agitator baffles partition said mixing chamber into at least three axial segments.

11. The method of claim 1 wherein said agitator includes flat faces and straight blades extending diagonally along said flat faces in a direction of a length of said agitator, said blades having arcuate portions, comprising rotating said agitator in said mixing chamber.

12. The method of claim 1 wherein the at least one said axial baffle includes a baffle assembly having a plate and support legs, wherein said support legs fasten said plate to the interior wall of said mixing chamber, and contacting only one side of said plate with said flowable material.

13. The method of claim 1 wherein said basic compound is selected from the group consisting of oxidized white liquor, oxidized green liquor, sodium hydroxide, a peroxide compound, ozone, sodium bicarbonate and combinations thereof.

14. The method of claim 1 wherein a value of horsepower to volume of said mixing assembly is 1 to 20 or greater, where horsepower is the power at which the motor is rated and volume is a volume of said mixing chamber in gallons.

15. The method of claim 1 comprising rotating said agitator at a rotating speed of at least 60 rpm.

16. The method of claim 1 comprising degassing said delignified pulp mixture that leaves said mixing assembly.

17. The method of claim 1 comprising providing first and second of said mixing assemblies in series; passing the delignified paper pulp mixture from the at least one said outlet of the first of said mixing assemblies to the at least one said inlet of the second of said mixing assemblies, and conducting a second delignification reaction in said second mixing assembly such that said delignified paper pulp mixture that exits said mixing chamber of said second mixing assembly is further delignified compared to said delignified paper pulp mixture that exits said mixing chamber of said first mixing assembly.

18. The method of claim 17 wherein a basic compound is added to said delignified paper pulp mixture that passes through the at least one inlet of said second mixing assembly.

19. The method of claim 1 wherein said oxygen-containing gas includes gas that is selected from the group consisting of $O_2$, $CO_2$, $O_3$, inert gas, steam and combinations thereof.

20. The method of claim 19 wherein said oxygen containing gas includes 90-94% $O_2$ gas with the balance being inert gas.

21. The method of claim 1 comprising carrying out said short delignification in said mixing assembly and then directing said delignifed paper pulp mixture into a lower end portion of a hollow tower for further oxygen delignification.

22. A short oxygen delignification method, comprising:

providing a mixing chamber having an interior wall which is substantially symmetrical about a central longitudinal axis;

providing at least one inlet for directing flowable material into said mixing chamber, wherein said flowable material includes a paper pulp fluid, steam, an oxygen-containing gas and a basic compound that is selected from the group consisting of oxidized white liquor, oxidized green liquor, sodium hydroxide, a peroxide compound, ozone, sodium bicarbonate and combinations thereof, wherein lignin is bound to said paper pulp;

providing at least one outlet from said mixing chamber;

providing at least one axial baffle connected to the interior wall and having a length extending along said axis;

providing at least two annular transverse baffles connected to the interior wall and having a major dimension extending from the interior wall transverse to said axis;

providing a rotatable agitator extending along the axis and comprising a plurality of twisted blades, wherein said rotatable agitator includes at least two circular agitator baffles extending substantially transverse to said axis each at a location in alignment with one of said transverse baffles, forming annular gaps defined by and extending between the aligned said agitator baffles and said transverse baffles;

bearings supporting said rotatable agitator for rotation near both ends of said mixing chamber;

wherein said aligned transverse baffles and said agitator baffles partition said mixing chamber into at least three axial segments;

directing said flowable material through said at least one inlet into said mixing chamber;

rotating said agitator inside said mixing chamber at a rotating speed that is at least 60 rpm;

disrupting substantially circumferential fluid flow in said mixing chamber with the at least one said axial baffle;

disrupting substantially axial fluid flow with said transverse baffles and said agitator baffles;

forcing said flowable material inside said chamber to travel through said annular gaps;

carrying out a short delignification reaction in said mixing chamber so as to break bonds between said lignin and said paper pulp and to dissolve said lignin, forming a delignified paper pulp mixture; and removing said delignified paper pulp mixture from said mixing chamber though the at least one said outlet;

wherein a residence time of said flowable material in said mixing chamber is not more than 2 minutes.

23. The method of claim 22 wherein a value of a ratio of horsepower to volume of said mixing assembly is at least 1 to 20, where horsepower is the power at which the motor is rated and volume is a volume of said mixing chamber in gallons.

24. The method of claim 22 comprising degassing said delignified paper pulp mixture.

* * * * *